US009474389B2

(12) United States Patent
Pfeifer et al.

(10) Patent No.: US 9,474,389 B2
(45) Date of Patent: Oct. 25, 2016

(54) CORRUGATED HUTCH

(71) Applicant: Menasha Corporation, Neenah, WI (US)

(72) Inventors: Mike Pfeifer, Hartford, WI (US); Keith Blake, West Bend, WI (US)

(73) Assignee: Menasha Corporation, Neenah, WI (US)

( * ) Notice: Subject to any disclaimer, the term of this patent is extended or adjusted under 35 U.S.C. 154(b) by 464 days.

(21) Appl. No.: 13/770,396

(22) Filed: Feb. 19, 2013

(65) Prior Publication Data

US 2013/0213915 A1 Aug. 22, 2013

Related U.S. Application Data

(60) Provisional application No. 61/600,934, filed on Feb. 20, 2012.

(51) Int. Cl.

| | |
|---|---|
| ***A47F 5/11*** | (2006.01) |
| ***A47B 43/02*** | (2006.01) |
| ***A47B 47/06*** | (2006.01) |

(52) U.S. Cl.

CPC ..... *A47F 5/11* (2013.01); *A47B 43/02* (2013.01); *A47B 47/06* (2013.01); *A47F 5/116* (2013.01)

(58) Field of Classification Search

CPC ..... A47F 5/116; A47F 5/0018; A47F 5/10; A47F 3/004; A47F 5/11; A47B 43/02; A47B 47/06; A47B 55/06

See application file for complete search history.

(56) References Cited

U.S. PATENT DOCUMENTS

| | | | |
|---|---|---|---|
| 1,827,008 | A | 10/1931 | Huckel |
| 1,912,847 | A | 6/1933 | Earl |

(Continued)

FOREIGN PATENT DOCUMENTS

| | | |
|---|---|---|
| EP | 0629557 A1 | 12/1994 |
| JP | 06278746 | 10/1994 |

OTHER PUBLICATIONS

LeBlanc, Rick; "Limits on Export Pallets Creating Corrugated Window of Opportunity; Corrugated Pallet Suppliers Experiencing Renewed Interest for Export, Domestic Markets"; http://www.palletenterprise.com/articledatabase/view.asp?articleID=648; 7 pages; Apr. 1, 2002.

*Primary Examiner* — Patrick Hawn
(74) *Attorney, Agent, or Firm* — Nixon Peabody LLP

(57) ABSTRACT

The present invention provides a display unit. The unit includes a hutch formed from corrugated material. The hutch has a back wall, a first side wall extending from a first end of the back wall, and a second side wall extending from a second end of the back wall. The back wall of the hutch includes a plurality of spaced horizontal slots. The hutch also includes a first side wall support attached to the first side wall, and a second side wall support attached to the second side wall. The first and second side wall supports include shelf support tabs. The hutch further includes a plurality of shelves formed from a foldable blank of material, each shelf having a tab insertable into one of the plurality of spaced horizontal slots, and supported by the shelf support tabs. In other embodiments, the display unit further includes a shelf support pad, a bottom tray, and a riser.

13 Claims, 22 Drawing Sheets

(56) References Cited

U.S. PATENT DOCUMENTS 1,992,373 A 2/1935 Johnson
2,018,707 A 10/1935 Daller
D104,437 S 5/1937 Bulman
2,150,743 A * 3/1939 Mancuso ..... G09F 5/00 211/135
2,339,656 A 1/1944 Shina
D146,386 S 2/1947 Shield
D153,188 S 3/1949 Stensgaard
D158,775 S 5/1950 Malkin
D158,776 S 5/1950 Malkin
2,706,066 A 4/1955 Wells
2,798,685 A 7/1957 Mooney
2,918,178 A * 12/1959 Leone ..... A47F 5/116 211/195
2,944,555 A 7/1960 Peel et al.
2,975,890 A 3/1961 Block
3,000,602 A 9/1961 O'Brien
3,026,015 A 3/1962 Severn
3,026,078 A 3/1962 Simkins
3,058,646 A 10/1962 Guyer
3,161,341 A 12/1964 Farquhar
D204,434 S 4/1966 Kingsford
3,480,196 A 11/1969 Simas
3,528,559 A 9/1970 Miller
3,690,118 A 9/1972 Rainwater
3,696,990 A 10/1972 Dewhurst
3,730,417 A 5/1973 Lawson
3,857,494 A 12/1974 Giardini
3,879,053 A 4/1975 Chvala
3,886,348 A 5/1975 Jonathan et al.
3,944,128 A 3/1976 Hogan
D239,805 S 5/1976 South
4,004,691 A 1/1977 Wihksne
D244,117 S 4/1977 Naylor
4,085,847 A 4/1978 Jacalone
4,099,813 A 7/1978 Olivan
4,171,741 A 10/1979 Fish
4,271,766 A * 6/1981 Schmiedeler ..... A47B 43/02 108/115
4,283,000 A 8/1981 White
4,292,901 A 10/1981 Cox
4,311,100 A * 1/1982 Gardner ..... A47F 5/116 108/165
4,375,874 A 3/1983 Leotta et al.
4,376,558 A 3/1983 Bandar
4,503,973 A 3/1985 Andersson
D278,493 S 4/1985 Brescia et al.
4,570,805 A * 2/1986 Smith ..... A47F 5/116 211/132.1
4,602,735 A 7/1986 Aaron
4,610,355 A 9/1986 Maurer
4,618,115 A 10/1986 Belokin, Jr.
4,646,922 A * 3/1987 Smith ..... A47F 5/116 211/132.1
4,658,984 A 4/1987 Brunner
4,673,092 A 6/1987 Lamson et al.
4,688,716 A 8/1987 Winterling
D292,659 S 11/1987 Svezia et al.
D293,520 S 1/1988 Ovitz, III
4,722,473 A 2/1988 Sandrini et al.
D294,908 S 3/1988 Childress
4,765,492 A 8/1988 Howard et al.
4,793,664 A 12/1988 Jackson
4,826,265 A 5/1989 Hockenberry
4,836,379 A 6/1989 Shaw
4,850,284 A 7/1989 DeGroot et al.
4,852,756 A 8/1989 Holladay
4,863,024 A 9/1989 Booth
4,871,067 A 10/1989 Valenti
4,877,137 A 10/1989 Govang et al.
4,911,084 A 3/1990 Sato et al.
4,911,311 A * 3/1990 Nagai ..... A47F 5/116 211/11
4,936,470 A 6/1990 Prindle
D321,100 S 10/1991 Dorrell
D321,295 S 11/1991 Nuebler
D321,615 S 11/1991 Lavine et al.
5,067,418 A 11/1991 Carter
5,119,740 A 6/1992 Carter
5,125,520 A 6/1992 Kawasaki
5,176,265 A 1/1993 Bennett
D332,883 S 2/1993 Staude
5,195,440 A 3/1993 Gottlieb
5,213,220 A 5/1993 McBride
5,259,631 A 11/1993 Brande
5,269,219 A 12/1993 Juvik-Woods
5,272,990 A 12/1993 Carter
5,315,936 A * 5/1994 Smith ..... A47F 5/116 108/165
D349,202 S 8/1994 Eliades et al.
D351,076 S 10/1994 Eliades et al.
5,357,875 A 10/1994 Winebarger et al.
5,388,531 A 2/1995 Crews et al.
5,413,053 A 5/1995 Vannatta
5,427,019 A 6/1995 Moorman
5,443,168 A * 8/1995 Dyment ..... A47F 5/116 211/149
D362,768 S 10/1995 Lechleiter et al.
D363,840 S 11/1995 Weshler
5,465,672 A 11/1995 Boyse et al.
5,487,344 A 1/1996 Hutchison
5,487,345 A 1/1996 Winebarger et al.
D369,035 S 4/1996 Potter
D369,043 S 4/1996 Parker
5,520,120 A 5/1996 Badger
5,528,994 A 6/1996 Iseli
5,540,536 A 7/1996 Hoedl
5,543,205 A 8/1996 Liebel
5,590,606 A 1/1997 Crews et al.
5,603,258 A 2/1997 Besaw
5,622,306 A 4/1997 Grigsby et al.
5,669,683 A * 9/1997 Moss ..... A47F 5/116 312/259
5,672,412 A 9/1997 Phares et al.
5,678,492 A * 10/1997 Pinkstone ..... A47F 5/116 108/165
5,685,234 A 11/1997 Grigsby et al.
D388,905 S 1/1998 Wells
5,706,953 A 1/1998 Polvere
5,706,959 A * 1/1998 Smith ..... A47F 5/116 108/165
5,711,423 A 1/1998 Fuller, Jr.
D395,534 S 6/1998 Besaw
5,762,213 A 6/1998 Heneveld, Sr.
5,791,487 A 8/1998 Dixon
5,794,542 A 8/1998 Besaw
5,797,499 A 8/1998 Pinco
D398,461 S 9/1998 Baluk et al.
D398,462 S 9/1998 Baluk et al.
5,809,903 A 9/1998 Young, Jr.
5,816,172 A 10/1998 Carter
5,826,732 A 10/1998 Ragsdale
5,832,841 A 11/1998 Crews et al.
5,881,652 A 3/1999 Besaw
D412,253 S 7/1999 Brozak, Jr.
5,918,744 A 7/1999 Bringard et al.
5,950,914 A 9/1999 Dunton et al.
5,980,008 A 11/1999 Stoever
5,996,366 A 12/1999 Renard
5,996,510 A 12/1999 Harpman et al.
D419,275 S 1/2000 Carter
D419,744 S 1/2000 Carter
6,012,399 A 1/2000 Carter
6,070,726 A 6/2000 Graham
6,076,475 A 6/2000 Kuhn et al.
D428,738 S 8/2000 Brozak, Jr.
6,098,820 A * 8/2000 Smith ..... A47F 5/116 211/132.1
6,126,131 A 10/2000 Tietz
6,126,254 A * 10/2000 Maglione ..... A47F 5/116 248/174
6,135,030 A 10/2000 Besaw
D433,782 S 11/2000 Carter
D433,839 S 11/2000 Culbertson

(56) References Cited

U.S. PATENT DOCUMENTS 6,145,671 A 11/2000 Riga et al.
6,145,794 A * 11/2000 Smith ..... A47F 5/108 211/132.1
6,164,215 A 12/2000 Cook et al.
6,189,778 B1 2/2001 Kanter
D453,057 S 1/2002 Sewell
6,354,229 B1 3/2002 Heidtke
6,357,587 B1 3/2002 Melms, Jr.
6,394,003 B1 5/2002 Lacy, III
D461,334 S 8/2002 Johnson et al.
D464,498 S 10/2002 Riga et al.
6,510,982 B2 1/2003 White et al.
6,585,118 B2 7/2003 Kellogg
6,612,247 B1 9/2003 Pistner et al.
6,612,669 B2 * 9/2003 Grueneberg ..... A47F 5/116 108/165
6,659,295 B1 12/2003 De Land et al.
6,715,623 B2 4/2004 Broerman
6,729,484 B2 5/2004 Sparkowski
6,752,280 B2 * 6/2004 Dye ..... A47F 5/116 108/162
6,758,352 B2 * 7/2004 Gervasi ..... A47F 5/0018 108/134
6,769,368 B2 8/2004 Underbrink et al.
D495,901 S 9/2004 Bosman
6,814,245 B2 11/2004 Leclerc et al.
6,902,074 B2 6/2005 Albrecht
6,905,021 B2 6/2005 Polumbaum et al.
D509,382 S 9/2005 Raile
6,951,300 B2 10/2005 Caille et al.
7,007,615 B2 * 3/2006 Grueneberg ..... A47F 5/116 108/165
D521,275 S 5/2006 Dusenberry
7,036,196 B2 5/2006 Salatin et al.
7,066,342 B2 6/2006 Baechle et al.
7,066,380 B2 6/2006 Blake
7,089,872 B2 8/2006 Wintermute, II et al.
7,111,735 B2 9/2006 Lowry
7,137,517 B2 11/2006 Lowry et al.
D533,734 S 12/2006 Campbell
7,191,906 B1 3/2007 Pinco
7,234,604 B2 6/2007 Eisele
D566,989 S 4/2008 Mason
D576,426 S 9/2008 Yuen-Schat et al.
D578,804 S 10/2008 Norman et al.
7,546,926 B2 6/2009 Stolle et al.
7,546,927 B2 6/2009 Lowry et al.
7,571,820 B2 * 8/2009 Alexander ..... A47F 5/116 211/73
D603,189 S 11/2009 Raile
7,650,996 B2 1/2010 Mark
7,677,433 B2 3/2010 Little
7,703,665 B2 4/2010 McGowan
7,703,864 B2 4/2010 Moser
7,717,265 B2 5/2010 Honkawa et al.
7,726,474 B2 6/2010 Berger et al.
7,828,169 B2 11/2010 Robinson et al.
7,882,966 B2 * 2/2011 Field ..... A47F 5/116 211/72
7,992,716 B2 8/2011 Jackson
8,002,171 B2 8/2011 Ryan et al.
8,141,713 B2 3/2012 Farkas et al.
8,317,039 B2 11/2012 Norman
8,485,370 B2 * 7/2013 Dewhurst ..... A47F 5/116 211/135
8,857,633 B2 * 10/2014 Dewhurst ..... A47F 5/116 211/135
2002/0189507 A1 12/2002 Benner
2003/0042828 A1 3/2003 Bonin
2003/0111383 A1 6/2003 Qiu et al.
2005/0252872 A1 11/2005 Eisele
2006/0006096 A1 1/2006 Funk
2006/0283775 A1 12/2006 Mark
2007/0193479 A1 8/2007 Slaats
2008/0169339 A1 * 7/2008 Moser ..... B65D 5/5213 229/108.1
2008/0169340 A1 * 7/2008 Sheffer ..... A47F 5/116 229/120.32
2008/0265726 A1 * 10/2008 Sheffer ..... A47B 47/06 312/259
2009/0107940 A1 4/2009 Norman et al.
2009/0127150 A1 5/2009 Meers
2010/0133215 A1 6/2010 Norman
2011/0000955 A1 1/2011 Manteufel et al.
2011/0049072 A1 3/2011 Dewhurst
2011/0266177 A1 11/2011 Lowry et al.
2012/0074037 A1 3/2012 Orischak et al.
2013/0097903 A1 4/2013 Gerstner

* cited by examiner

CORRUGATED HUTCH

CROSS-REFERENCE TO RELATED APPLICATIONS

The present application claims the benefit of U.S. Provisional Application No. 61/600,934 filed Feb. 20, 2012, the contents of which are incorporated herein by reference.

FEDERALLY SPONSORED RESEARCH OR DEVELOPMENT

N/A

TECHNICAL FIELD

The present invention generally relates to a display unit in the form of a hutch having a plurality of shelves formed from a corrugated material.

BACKGROUND OF THE INVENTION

A variety of display units are available for displaying products or other items. However, most display units are expensive to ship and construct. The present invention provides a hutch with a plurality of shelves that overcomes the problems of prior units.

SUMMARY OF THE INVENTION

The present invention provides a display unit that is easily constructed and shipped. The unit includes a hutch formed from a corrugated material, such as cardboard. The unit also includes a plurality of shelves. The shelves are also formed from a corrugated material. The hutch has a back wall, a first side wall extending from a first end of the back wall, and a second side wall extending from a second end of the back wall. The back wall of the hutch includes a plurality of spaced horizontal slots. The hutch also includes a first side wall support attached to the first side wall, and a second side wall support attached to the second side wall. The first and second side wall supports include shelf support tabs. The hutch further includes a plurality of shelves formed from a foldable blank of material, each shelf having a tab insertable into one of the plurality of spaced horizontal slots, and supported by the shelf support tabs. In other embodiments, the display unit further includes a shelf support pad, a bottom tray, and a riser.

BRIEF DESCRIPTION OF THE DRAWINGS

To understand the present invention, it will now be described by way of example, with reference to the accompanying drawings in which.

DETAILED DESCRIPTION

Figure 1:
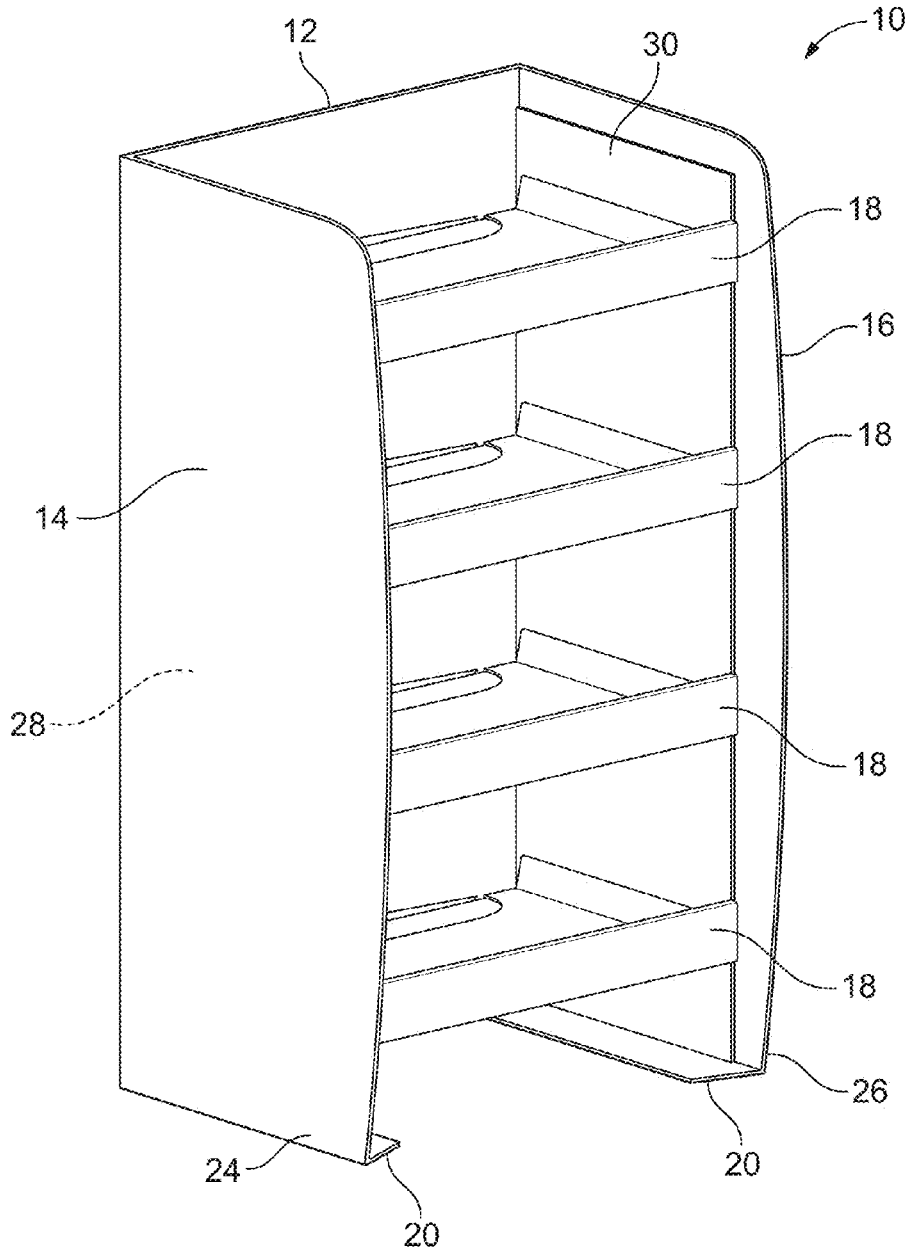
FIG. 1 is a perspective view of a hutch display unit in accord with an embodiment of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIGS. 1 through 5, an embodiment of a hutch display unit 10 of the present invention is shown. The unit 10 includes a back wall 12, and side walls 14 and 16. The unit 10 also includes a plurality of shelves 18. Each of the back wall 12 and side walls 14 and 16 include feet 20 at their respective bottom portions 22, 24, and 26. The unit 10, including the back wall 12, side walls 14 and 16, shelves 18, and feet 20 are preferably made of a corrugated material, including paper or plastic. Each of the side walls 14 and 16 include an inner support 28 and 30, respectively.

Figure 2:
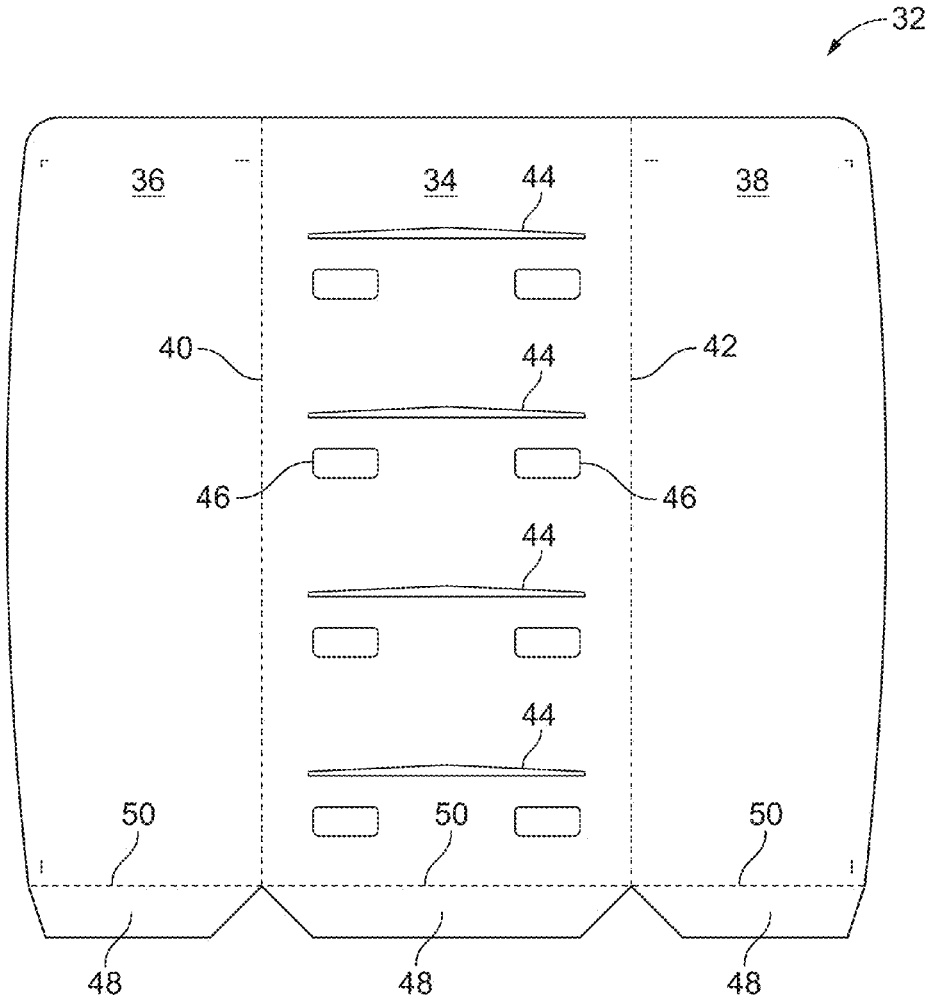
FIG. 2 is a plan view of a blank used to construct the back wall and side walls of the display unit of an embodiment of the present invention.

FIG. 2 shows a blank 32 for constructing the back wall 12 and side walls 14 and 16. The blank 32 includes back wall panel 34, and side wall panels 36 and 38. The back wall panel 34 and side wall panels 36 and 38 are joined at fold lines 40 and 42, respectively. The back wall panel 34 includes a plurality of spaced slots 44. In the shown embodiment, the slots 44 are generally triangular-shaped, but can be any suitable shape. The back wall panel 34 also includes sets of generally rectangular cutouts 46 located in pairs beneath the slots 44. Each of the back wall panel 34, and side wall panels 36 and 38 include a foot panel 48. The foot panels 48 are joined at fold lines 50 to their respective back wall panel 34 and side wall panels 36 and 38.

Figure 3:
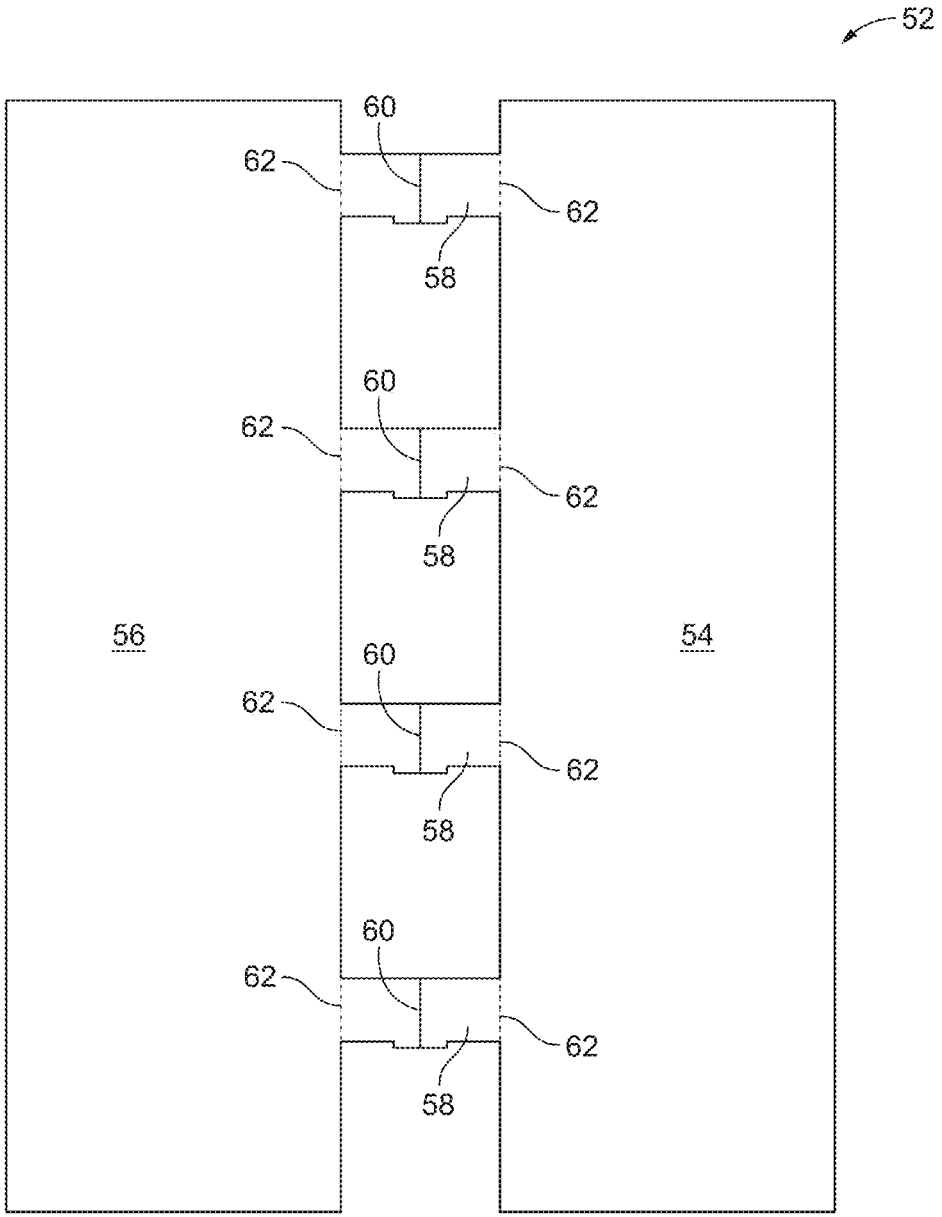
FIG. 3 is a plan view of a blank used to construct the inner supports of the display unit of an embodiment of the present invention.

FIG. 3 shows a blank 52 for constructing the inner supports 28 and 30. The blank 52 includes left inner support panel 54 and a right inner support panel 56. The left and right inner support panels 54 and 56 are connected by a plurality of shelf support panels 58. The left and right inner support panels 54 and 56 are separated along cut lines 60. The shelf support panels 58 are connected to the left and right inner support panels 54 and 56 along fold lines 62.

Figure 4:
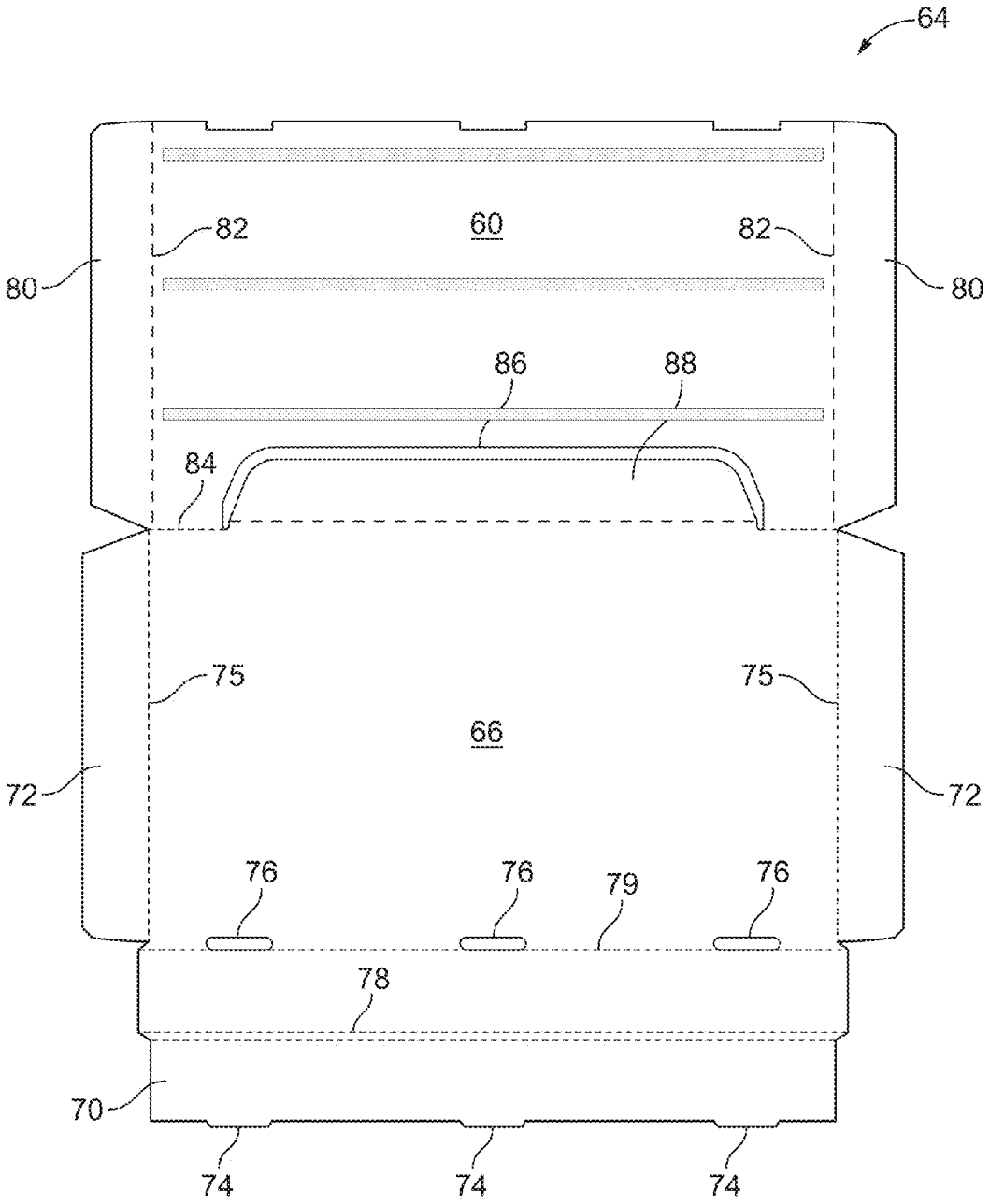
FIG. 4 is a plan view of a blank used to construct the shelf of the display unit of an embodiment of the present invention.

FIG. 4 shows a blank 64 for constructing the shelves 18. The blank 64 includes a bottom panel 66 and a top panel 68. The bottom panel 66 includes front panel 70 and side panels 72. The front panel 70 has tabs 74. The bottom panel 66 has slots 76 adapted to accept the tabs 74 when the front panel is folded at fold lines 78 and 79 to create a shelf 18.

The top panel 68 includes side panels 80 connected to the top panel 68 at fold lines 82. The top panel 68 is also connected to the bottom panel 66 along fold line 84. The top panel 68 also includes a generally trapezoidal slot 86, which forms a tab 88 for use as described below.

Figure 5:
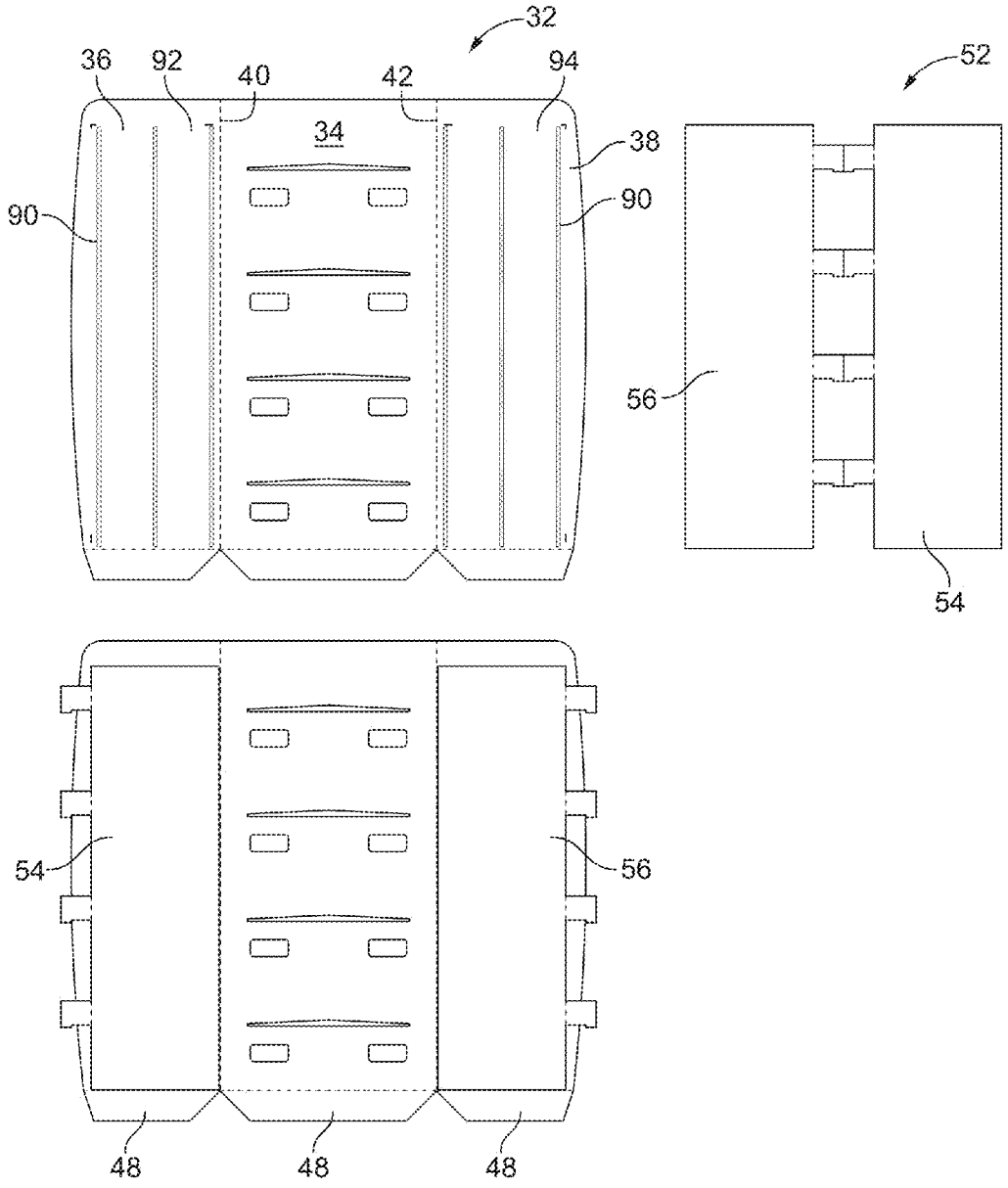
FIG. 5 is a schematic diagram showing construction of a portion of the display unit of an embodiment of the present invention.
Figure 6:
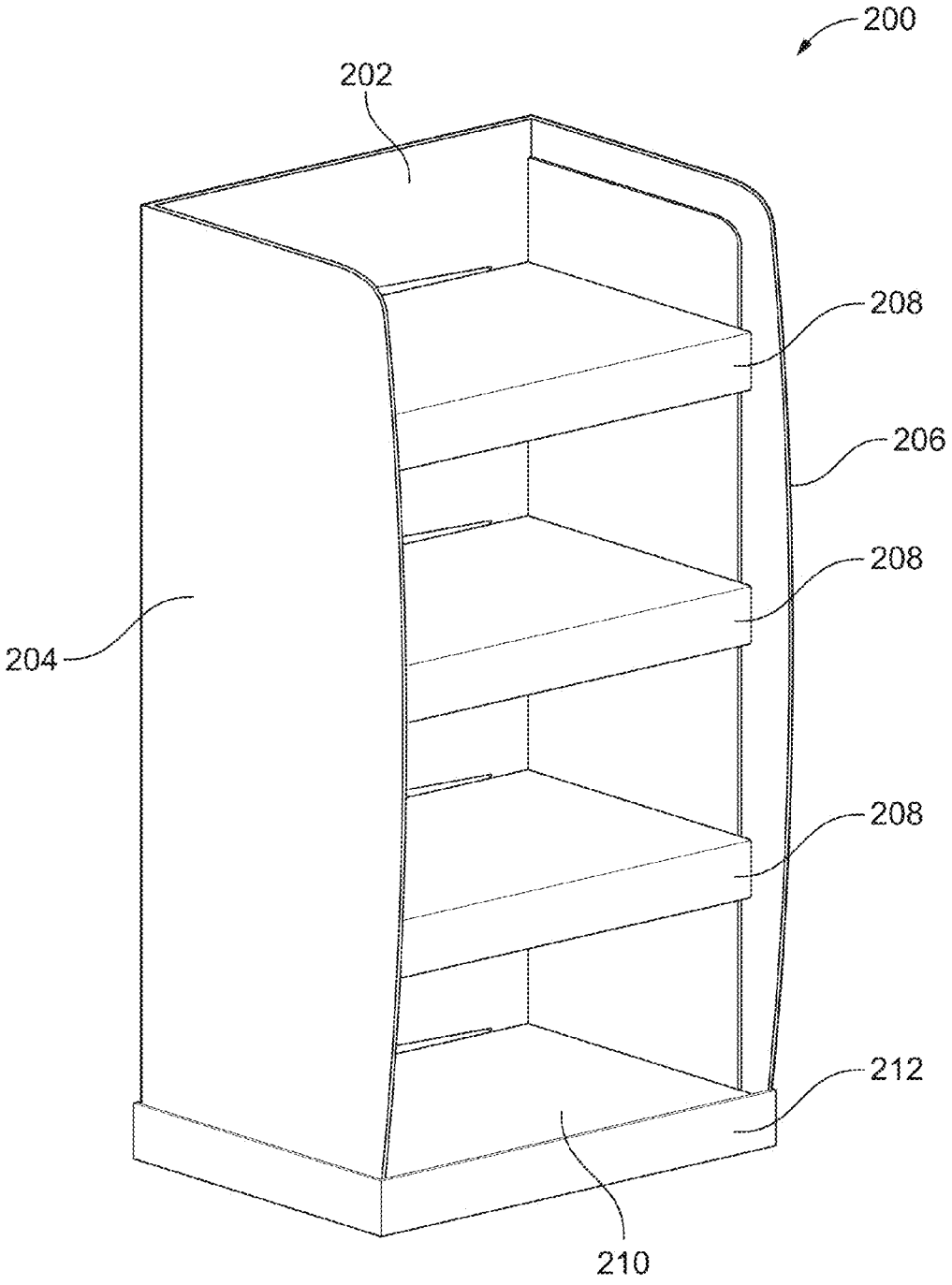
FIG. 6 is a perspective view of a hutch display unit of an embodiment of the present invention.

To construct the unit 10 from the blanks 32, 52, and 64, the blank 52 is separated along cut lines 60 into the left and right inner support panels 54 and 56. The panels 54 and 56 are glued along glue lines 90 to the inner surfaces 92 and 94 of the side wall panels 36 and 38 of blank 32, respectively, such that the shelf support panels 58 face away from the back wall panel 34 as shown in FIG. 5. The left and right inner support panels 54 and 56 are located such that they are above the foot panels 48. The foot panels 48 are folded inward along fold lines 50.

The left and right side wall panels 36 and 38 are folded in the same direction along fold lines 40 and 42 such that they are substantially parallel. The shelf support panels 58 are folded inward at fold lines 62 from the left and right side wall panels 36 and 38.

To construct the shelves 18, glue lines 96 are placed on the underside of the top panel 68. The side panels 80 are folded upward along fold lines 82. The top panel 68 is folded along fold line 84 over the bottom panel 66, and glued to the topside of the bottom panel 66. The top panel 68 on its free end has cutouts 98 that correspond to the slots 76 in the bottom panel 66 so as not to obstruct them when they are glued together. The side panels 72 of the bottom panel 66 are also folded upwards. The tab 88 of the shelf 18 is inserted into the slot 44 in the back wall panel 34. The shelf 18 is placed beneath the shelf support panels 58. The front panel 70 is folded upward along fold lines 78 and 79, and the tabs 74 are inserted into the slots 76 to form a lip 100 in shelf 18 such that the side support panels are sandwiched between folds in the lip 100. This is repeated for every shelf 18.

Another embodiment of the present invention is shown in FIGS. 6 through 16, which show an embodiment of a hutch display unit 200. The unit 200 includes a back wall 202, and side walls 204 and 206. The unit 200 also includes a plurality of shelves 208, a riser 210, and a bottom tray 212. The unit 200, including the back wall 202, side walls 204 and 206, shelves 208, riser 210, and bottom tray 212 is preferably made of a corrugated material, including paper or plastic. Each of the side walls 204 and 206 include an inner support 214 and 216, respectively.

Figure 7:
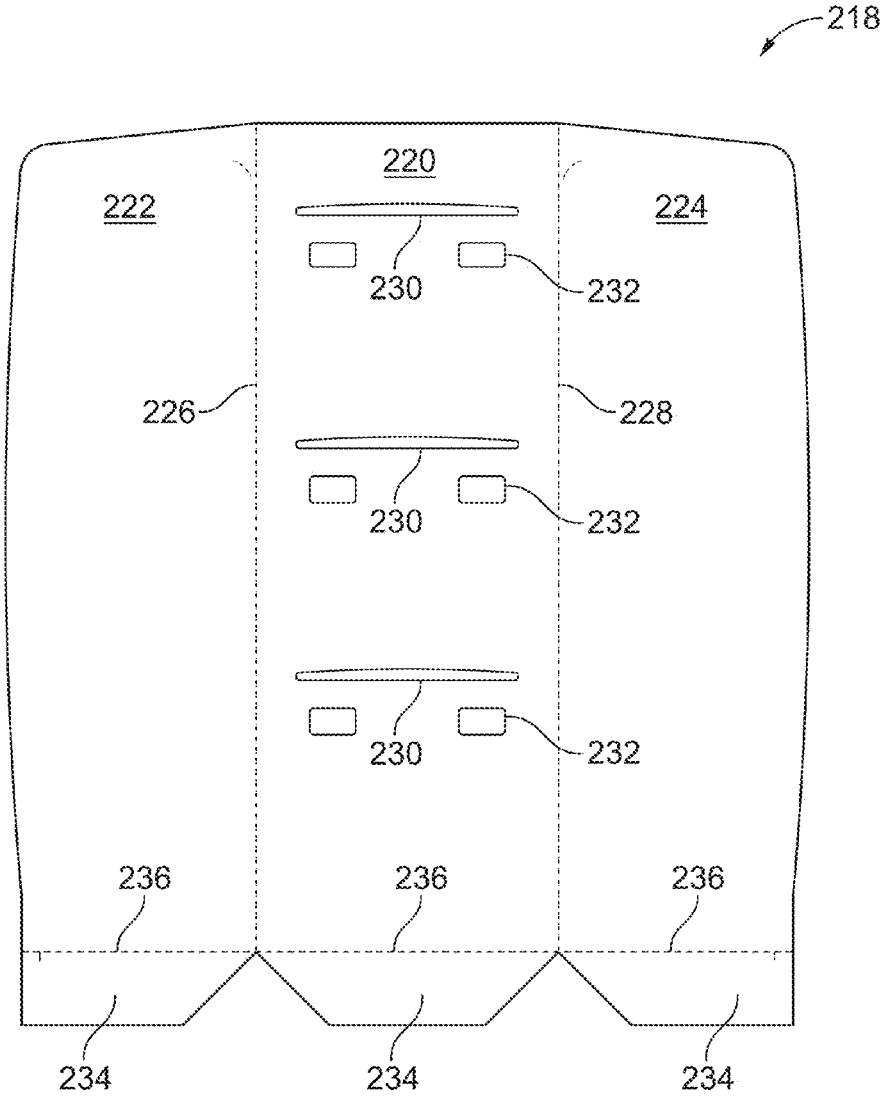
FIG. 7 is a plan view of a blank used to construct the back wall and side walls of the display unit of an embodiment of the present invention.

FIG. 7 shows a blank 218 for constructing the back wall 202 and side walls 204 and 206. The blank 218 includes back wall panel 220, and side wall panels 222 and 224. The back wall panel 220 and side wall panels 222 and 224 are joined at fold lines 226 and 228, respectively. The back wall panel 220 includes a plurality of spaced slots 230. In the shown embodiment, the slots 230 are generally oblong-shaped, but can be any suitable shape. The back wall panel 220 also includes sets of generally rectangular cutouts 232 located in pairs beneath the slots 230. Each of the back wall panel 220, and side wall panels 222 and 224 include a foot panel 234. The foot panels 234 are joined at fold lines 236 to their respective back wall panel 220 and side wall panels 222 and 224.

Figure 8:
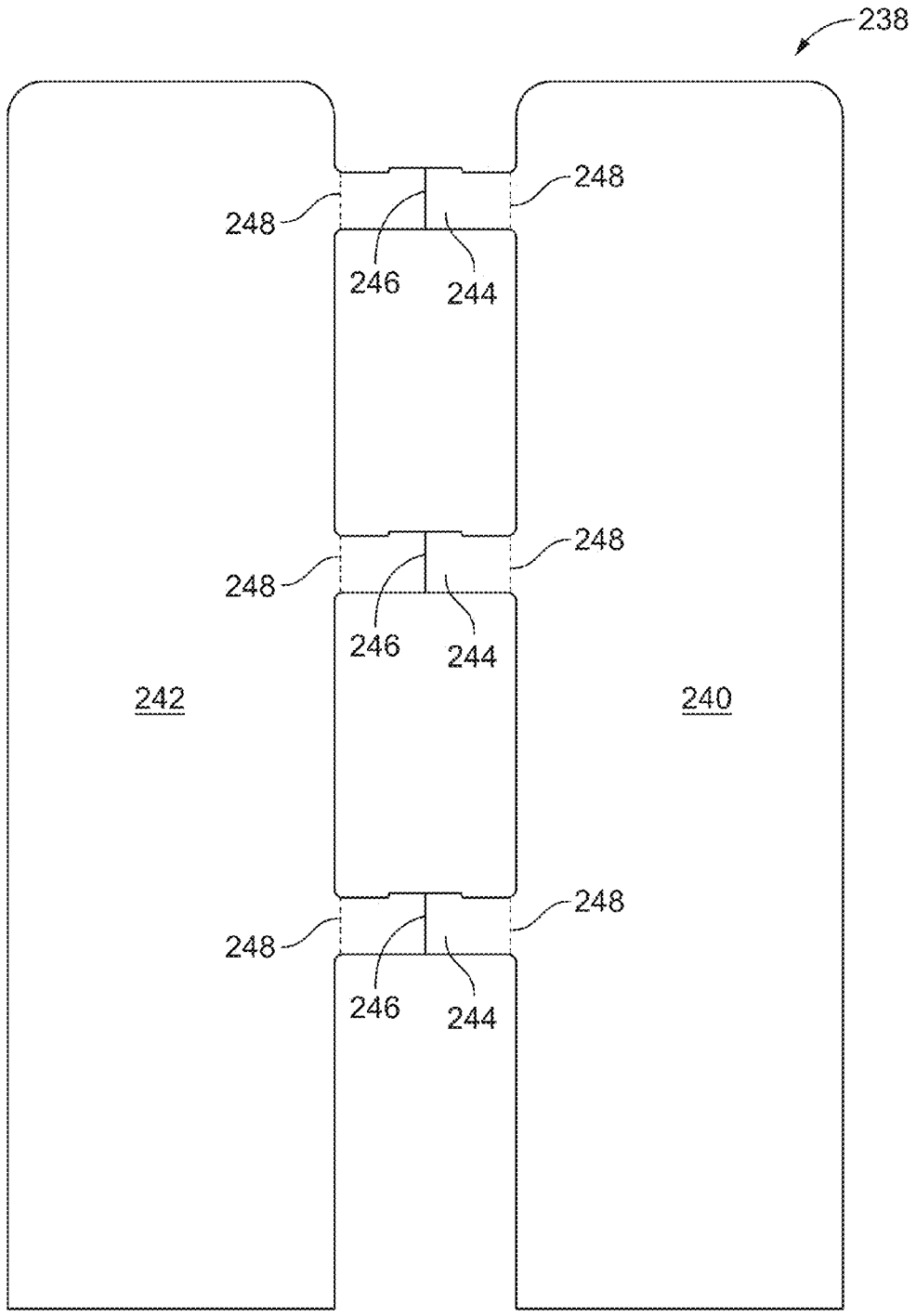
FIG. 8 is a plan view of a blank used to construct the inner supports of the display unit of an embodiment of the present invention.
Figure 9:
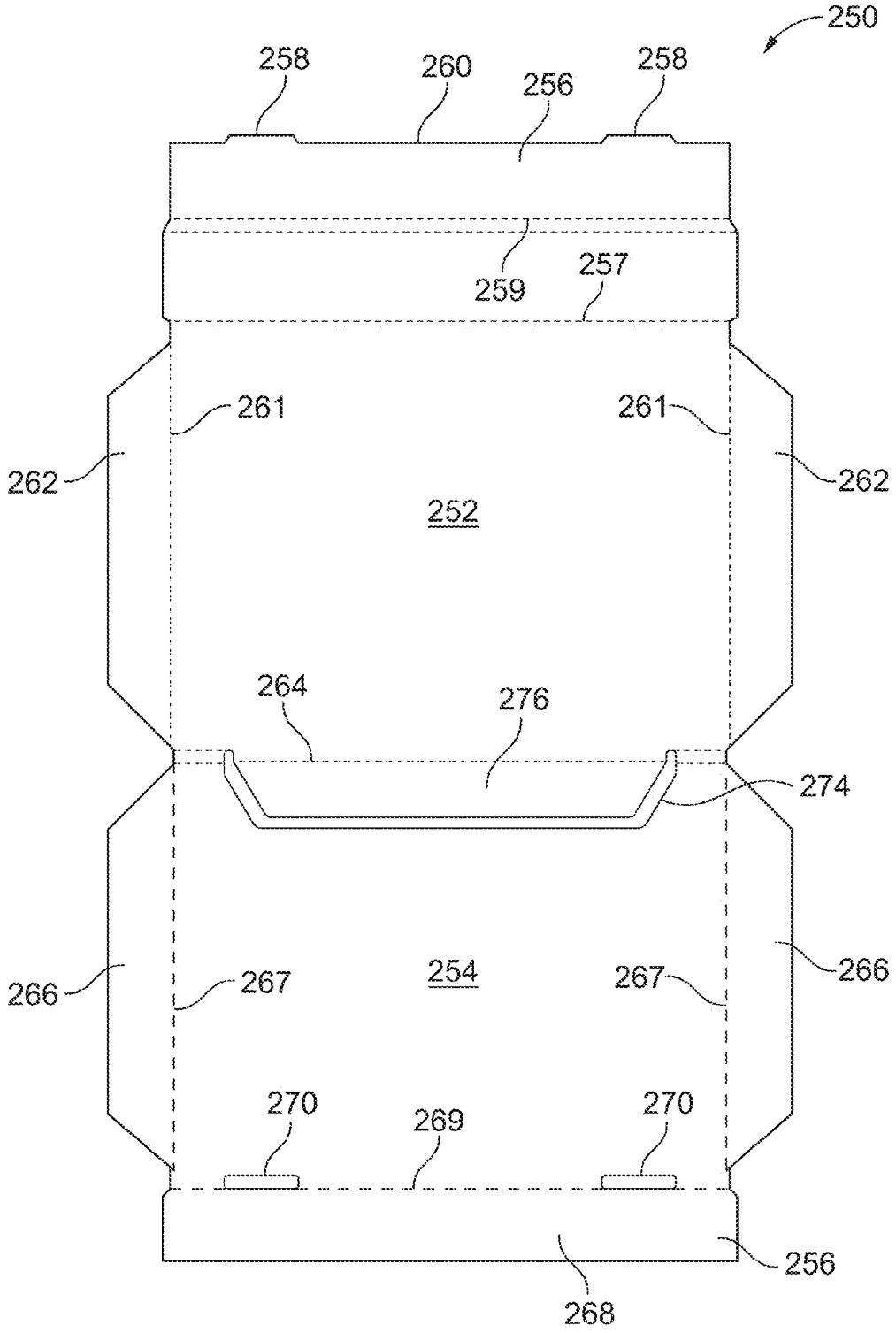
FIG. 9 is a plan view of a blank used to construct the shelf of the display unit of an embodiment of the present invention.

FIG. 8 shows a blank 238 for constructing the inner supports 214 and 216. The blank 238 includes left inner support panel 240 and a right inner support panel 242. The left and right inner support panels 240 and 242 are connected by a plurality of shelf support panels 244. The left and right inner support panels 240 and 242 are separated along cut lines 246. The shelf support panels 244 are connected to the left and right inner support panels 240 and 242 along fold lines 248.

In this embodiment, a shelf blank 250 (FIG. 9), includes a top panel 252 and a bottom panel 254. The top panel 252 has a front panel 256 attached to the top panel 252 along fold line 257 with tabs 258 along its free edge 260, and side panels 262 attached to the top panel 252 along fold lines 261. The top panel 252 includes an additional fold line 259. The top panel 252 and bottom panel 254 are joined at fold line 264. The bottom panel 254 includes side panels 266 attached to the bottom panel 254 along fold lines 267, and a front panel 268 attached to the bottom panel 254 along fold line 269. The bottom panel 254 has slots 270 adapted to accept tabs 258 when a shelf 208 is constructed from shelf blank 250. The bottom panel 254 has a trapezoidal slot 274 that forms a tab 276.

Figure 10:
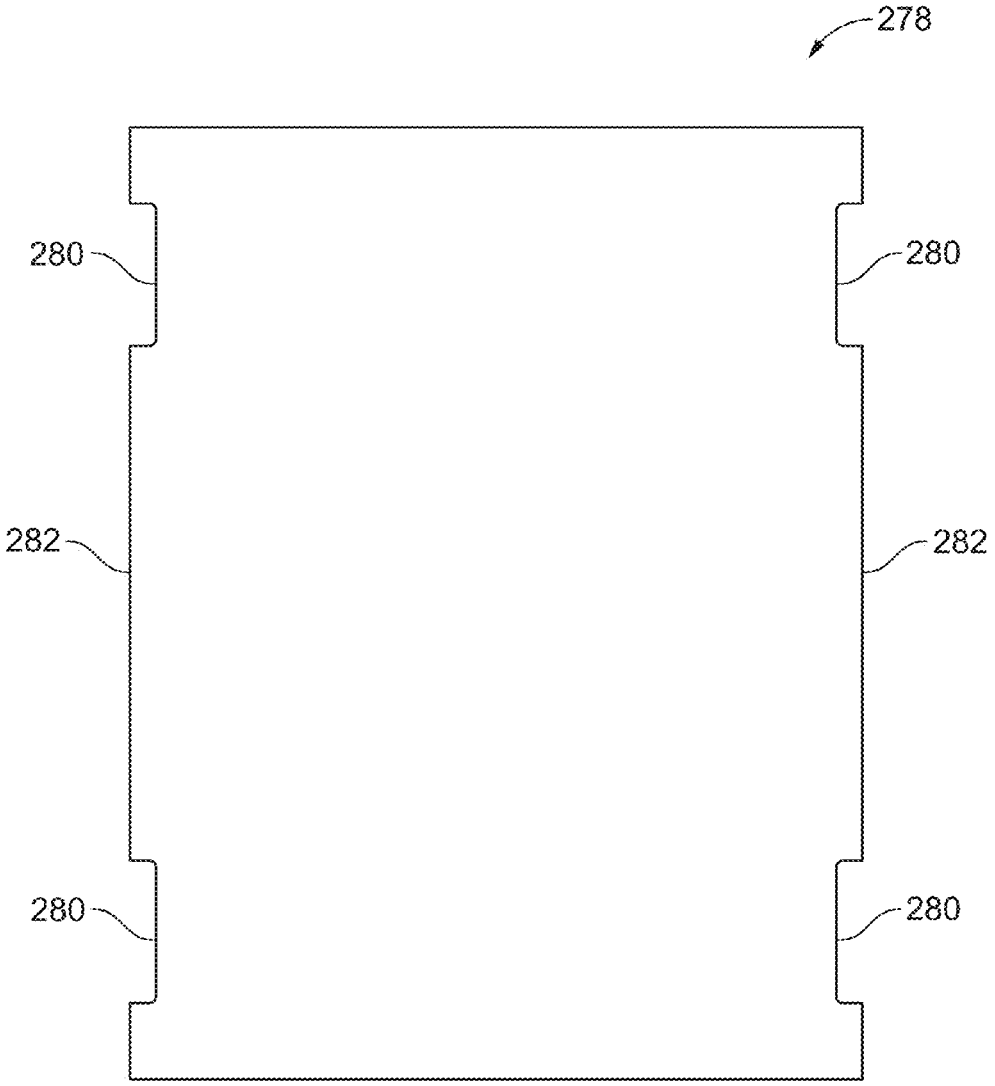
FIG. 10 is a plan view of a shelf support pad of the display unit of an embodiment of the present invention.

In this embodiment a shelf support pad 278 is provided (FIG. 10). The pad 278 is a generally rectangular planar sheet of preferably corrugated material, and has opposing cutouts 280 along opposite edges 282.

Figure 11:
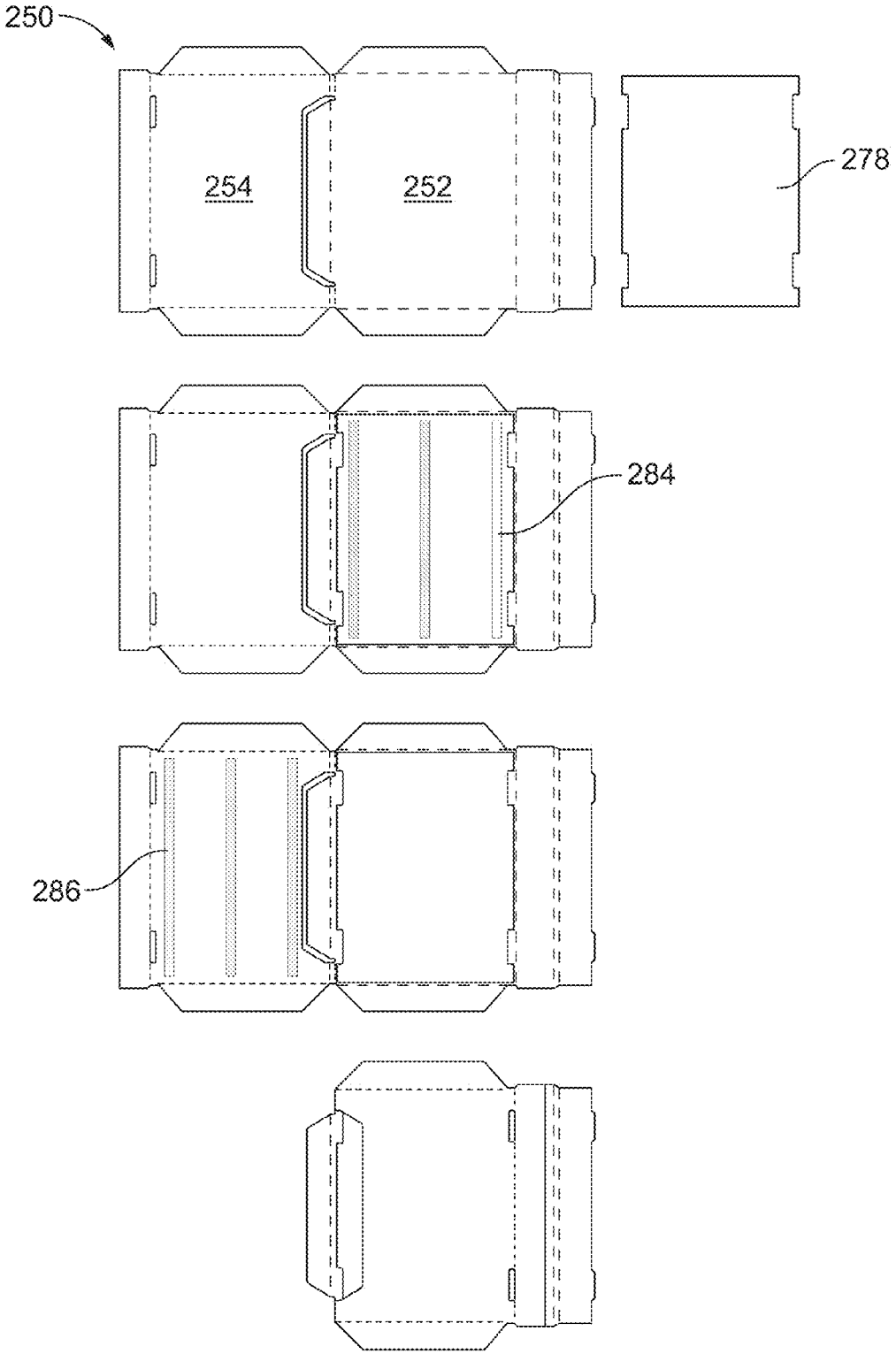
FIG. 11 is a schematic diagram showing construction of the shelf of the display unit of an embodiment of the present invention.
Figure 12:
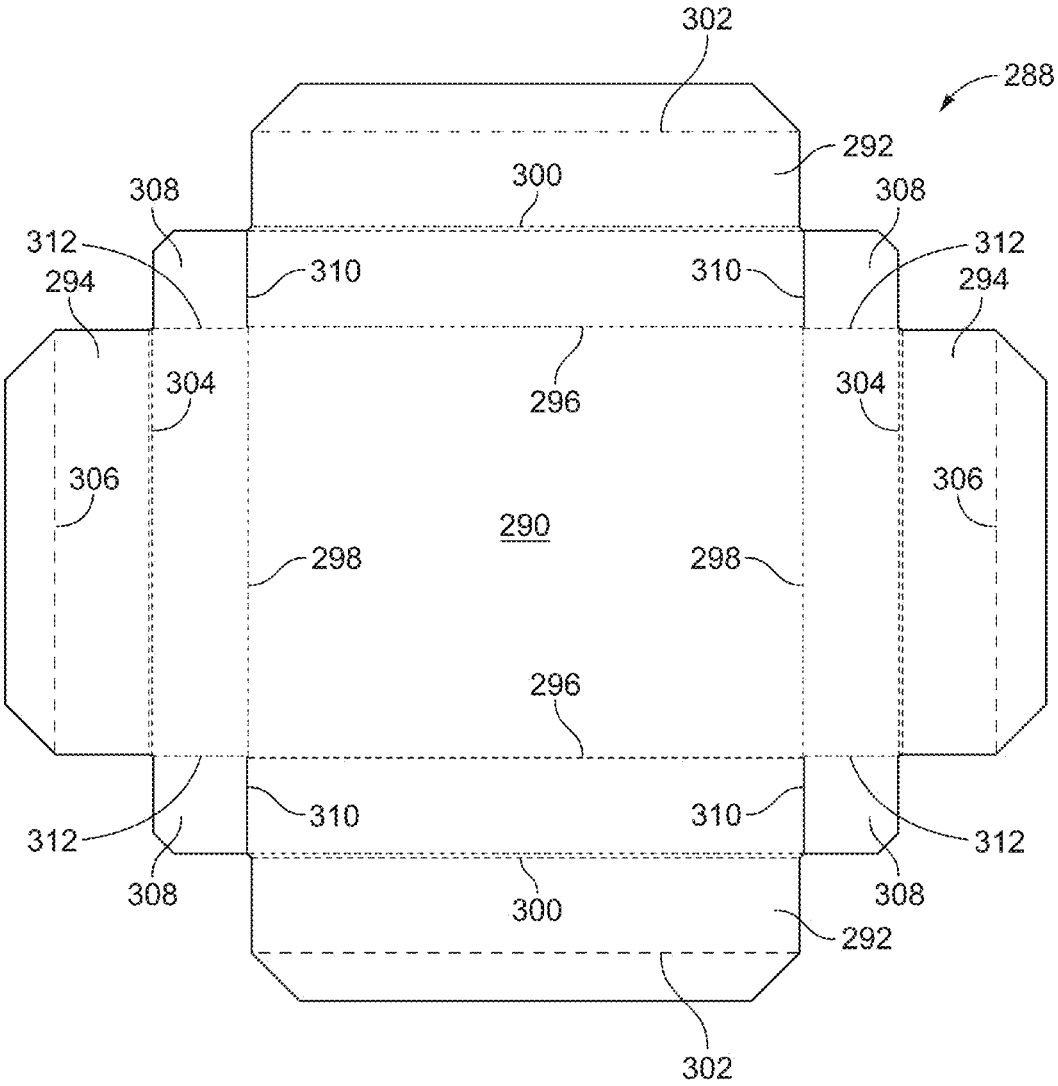
FIG. 12 is a plan view of a blank used to construct the bottom tray of the display unit of an embodiment of the present invention.
Figure 13:
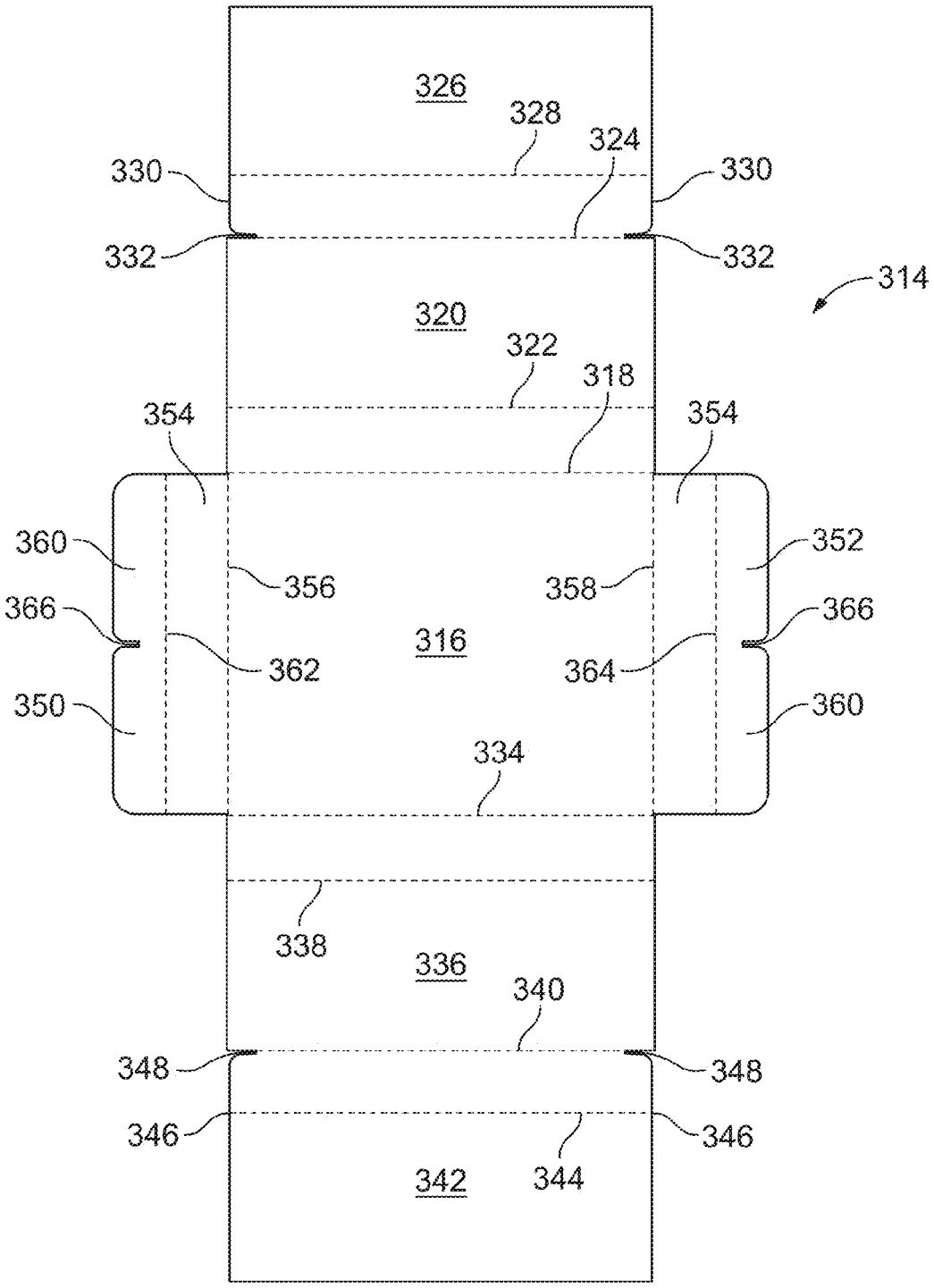
FIG. 13 is a plan view of a blank used to construct the riser of the display unit of an embodiment of the present invention.
Figure 14:
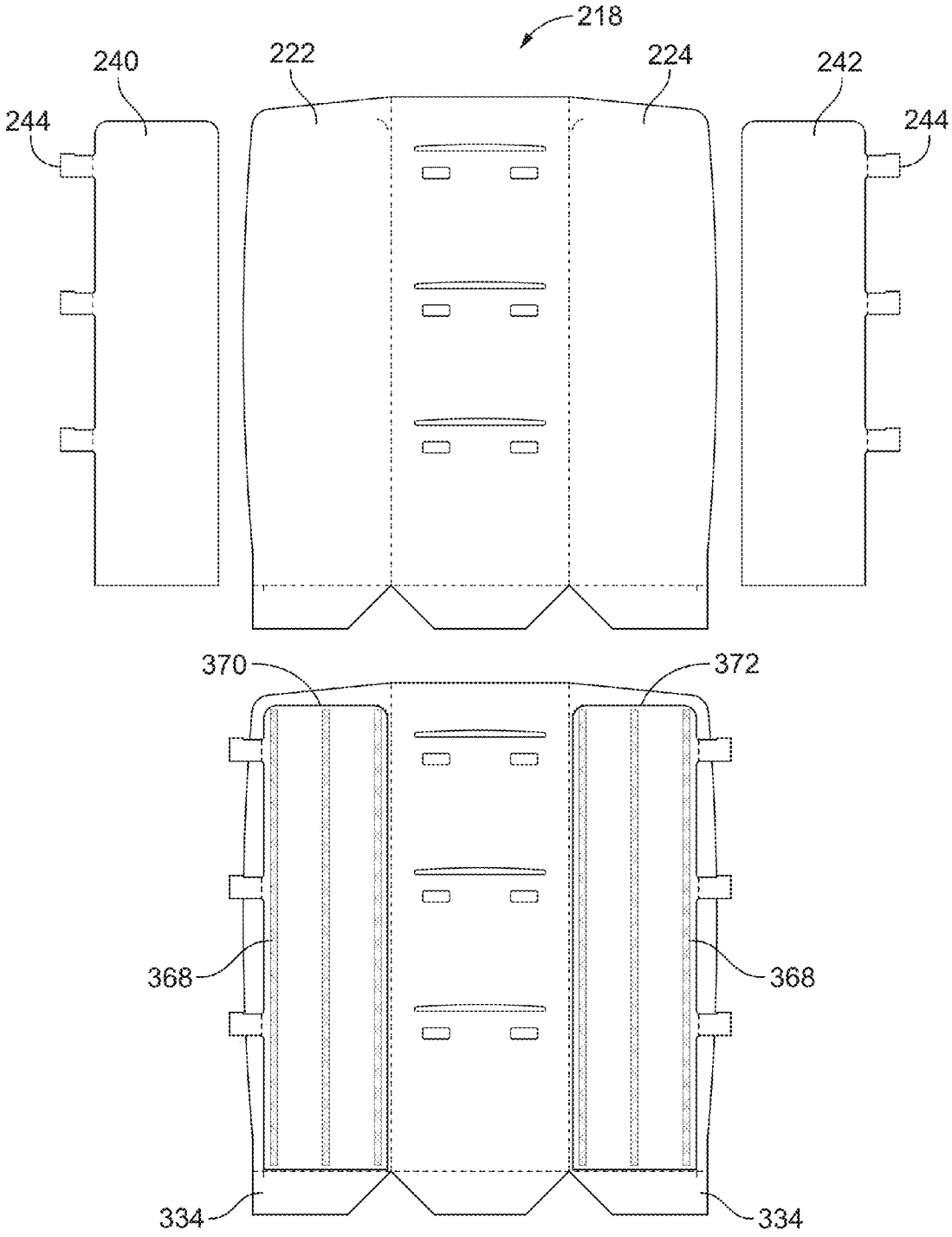
FIG. 14 is a schematic diagram showing construction of a portion of the display unit of an embodiment of the present invention.

As shown in FIG. 11, to construct a shelf 208 from the shelf blank 250 and shelf support pad 278, the pad 278 is placed squarely on top of the top panel 252, and glued to the top panel 252 along glue lines 284. Glue is placed on the underside of the bottom panel 254 along glue lines 286, and the bottom panel 254 is folded along fold line 264 over the shelf support pad 278 and top panel 252, and glued to the shelf support pad 278. The front panel 256 is folded along fold lines 257 and 259 such that the tabs 258 engage slots 270 in the bottom panel 254.

In this embodiment, a bottom tray 212 is provided. The bottom tray 212 is formed from a bottom tray blank 288 (FIG. 12), which includes a bottom panel 290, and opposing side panels 292 and end panels 294 connected to the bottom panel 290 along fold lines 296 and 298, respectively. The side panels 292 include fold lines 300 and perforation lines 302. The end panels 294 include fold lines 304 and perforation lines 306. The bottom tray blank 288 also includes corner folds 308. Folds 308 include a perforation line 310 and a fold line 312.

In this embodiment, a riser 210 (FIG. 13) is provided to act as a bottom shelf. The riser 210 is formed from a riser blank 314, and includes a shelf panel 316. Attached to one end of the shelf panel 316 along a first fold line 318 is a first support panel 320. The first support panel 320 includes a second fold line 322 spaced from and parallel to the first fold line 318. Attached to the first support panel 320 along a third fold line 324 is a second support panel 326. The second support panel 326 includes a fourth fold line 328 spaced from and parallel to the third fold line 324. The second support panel 326 is of length slightly less than that of the first support panel 320. At opposite edges 330 of the third fold line 324 are cutouts 332.

Attached to the shelf panel 316 opposite to the first support panel 320 along a fifth fold line 334 is a third support panel 336. The third support panel 336 includes a sixth fold line 338 spaced from and parallel to the fifth fold line 334. Attached to the third support panel 336 along a seventh fold line 340 is a fourth support panel 342. The fourth support panel 342 includes an eighth fold line 344 spaced from and parallel to the seventh fold line 340. The fourth support panel 342 is of a length slightly less than that of the third support panel 336. At opposite edges 346 of the seventh fold line 340 are cutouts 348.

Attached to the shelf panel 316 at opposing ends are a first locking flap 350 and a second locking flap 352. Each of the first and second locking flaps 350 and 352 include a first panel 354 attached to the shelf panel 316 at fold lines 356 and 358, respectively, and a locking tab panel 360 attached to the first panel 354 at fold lines 362 and 364. The locking tab panels 360 include at substantially the center of their length a cutout 366.

To construct the unit 200 (FIG. 14), the blank 238 is separated along cut lines 246 into the left and right inner support panels 240 and 242. The panels 240 and 242 are glued along glue lines 368 to inner surfaces 370 and 372 of the side wall panels 222 and 224 of blank 218, respectively, such that the shelf support panels 244 face away from the back wall panel 220. The left and right inner support panels 240 and 242 are located such that they are above the foot panels 234.

The left and right side wall panels 222 and 224 are folded in the same direction along fold lines 226 and 228 such that they are substantially parallel. The shelf support panels 244 are folded inward at fold lines 248 from the left and right side wall panels 222 and 224. The foot panels 234 are folded inward along fold lines 236. The shelves 208 are constructed as indicated above. The tab 276 of the shelf 208 is inserted into the slot 230 in the back wall panel 220. The shelf 208 is placed such that it rests on the shelf support panels 244. This is repeated for every shelf 208.

The bottom tray 212 is constructed from its blank 288 by separating the folds 308 along perforation lines 310 folding the side such that the folds 308 are detached from the side panels 292. The end panels 294 are folded inward toward the bottom panel 290 along fold lines 298 and 304 such that the folds 308 are inside of the side panels 292. After folding, the end panels 294 are glued. Side panels are then folded inward to the bottom panel 290 along fold lines 296 and 300 such that the folds 308 are captured. After folding the side panels 292 are also glued. The side panels 292 and end panels 294 are folded along perforations 302 and 306. The constructed blank 218 is inserted into the bottom tray 212.

The riser 210 is constructed from riser blank 314. The first support panel 320, second support panel 326, third support panel 336, and fourth support panel 342 are folded inward toward the shelf panel 316 along first fold line 318, second fold line 322, third fold line 324, fourth fold line 328, fifth fold line 334, sixth fold line 338, seventh fold line 340 and eighth fold line 344 such that the second support panel 326 and fourth support panel 342 are folded under the first support panel 320 and third support panel 336. The first and second locking flaps 350 and 352 are folded inward along fold lines 356, 358, 362, and 364, and the cutouts 366 interlock with the cutouts 332 and 348. The constructed riser 210 is inserted into the bottom tray 212.

Figure 15:
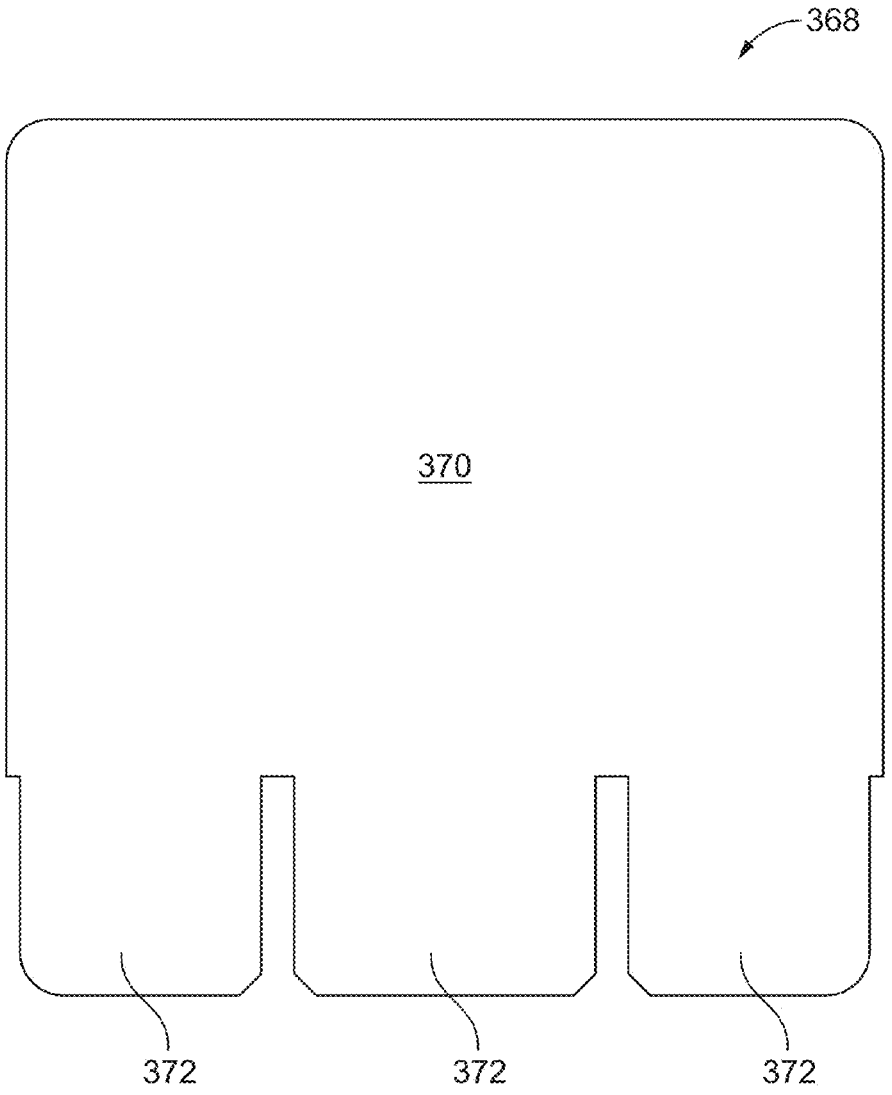
FIG. 15 is a plan view of a header of the display unit of an embodiment of the present invention.

In this embodiment a header 368 (FIG. 15) may be attached to the back wall 202 for display or other purposes. The header 368 includes a planar surface area 370 and attachment tabs 372. The tabs 372 facilitate attachment to the back wall 202. All of the embodiments described herein may include a similar header as shown in FIG. 15.

Figure 16:
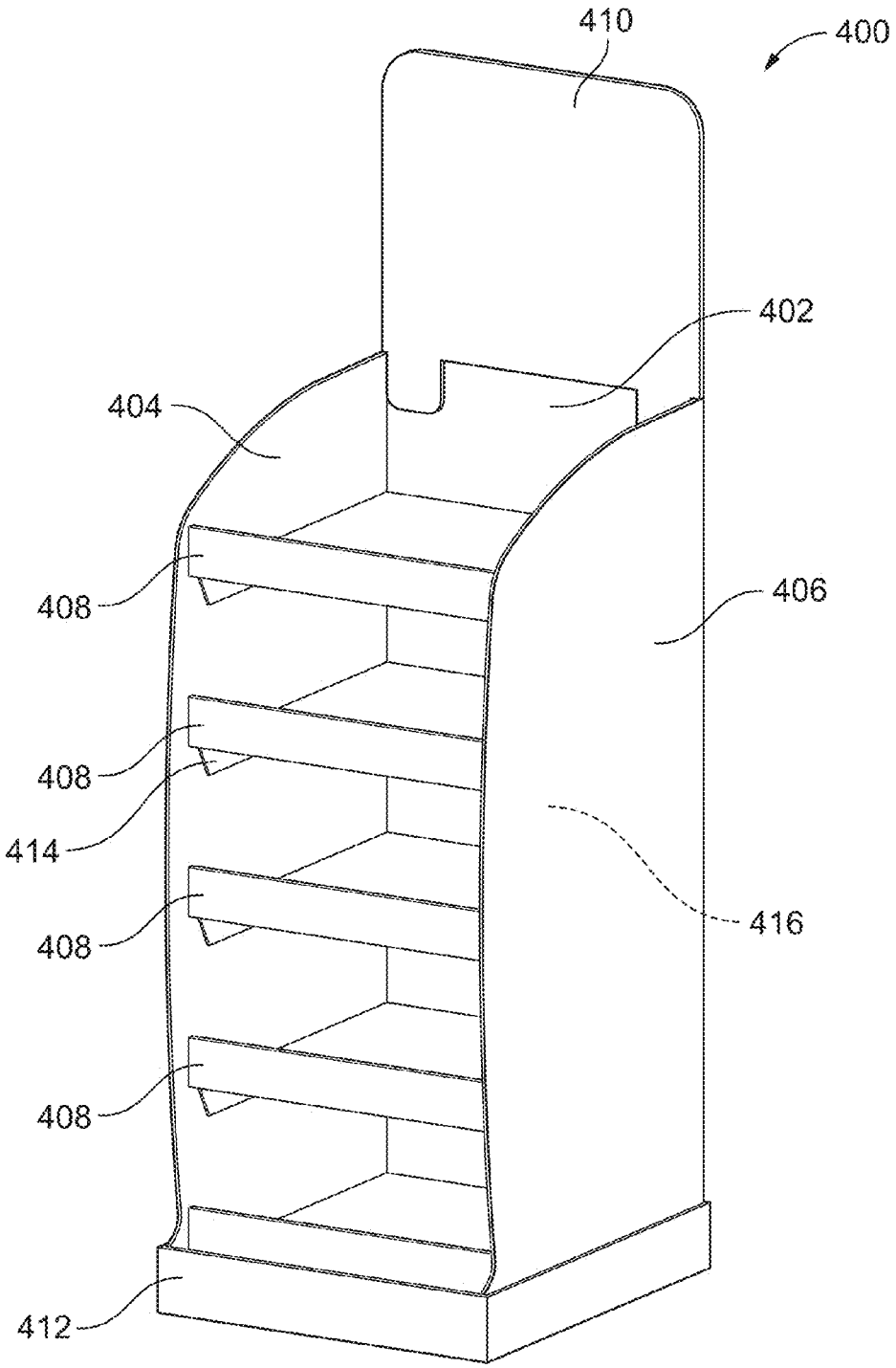
FIG. 16 is a perspective view of a hutch display unit of an embodiment of the present invention.

Another embodiment of the hutch of the present invention is shown in FIGS. 16 through 22. FIG. 16 shows a hutch unit 400 having a back wall 402, and side walls 404 and 406. The hutch 400 also includes a plurality of shelves 408, and a header 410 attached to the back wall. The hutch 400 also includes a bottom tray 412. The unit 400, including the back wall 402, side walls 404 and 406, shelves 408, and bottom tray 410 is preferably made of a corrugated material, including paper or plastic. Each of the side walls 404 and 406 include an inner support 414 and 416, respectively.

Figure 17:
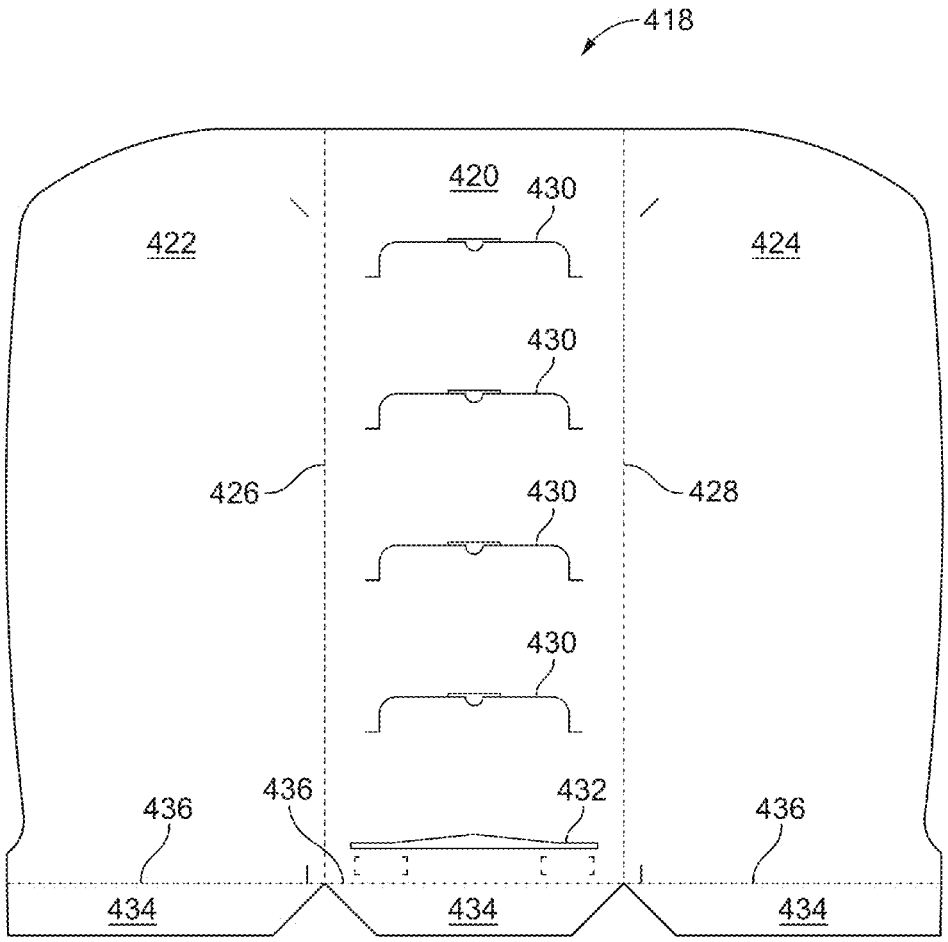
FIG. 17 is a plan view of a blank used to construct the back wall and side walls of the display unit of an embodiment of the present invention.

FIG. 17 shows a blank 418 for constructing the back wall 402 and side walls 404 and 406. The blank 418 includes back wall panel 420, and side wall panels 422 and 424. The back wall panel 420 and side wall panels 422 and 424 are joined at fold lines 426 and 428, respectively. The back wall panel 420 includes a plurality of spaced perforated slots 430. In the shown embodiment, the slots 430 are generally trapezoidal-shaped, but can be any suitable shape. Each slot has an associated finger hole 431 for manually creating an opening in the back wall 402 by pulling on the perforations of slots 430. The back wall panel 420 also includes a generally triangular shaped slot 432 near its bottom. Each of the back wall panel 420, and side wall panels 422 and 424 include a foot panel 434. The foot panels 434 are joined at fold lines 436 to their respective back wall panel 420 and side wall panels 422 and 424.

Figure 18:
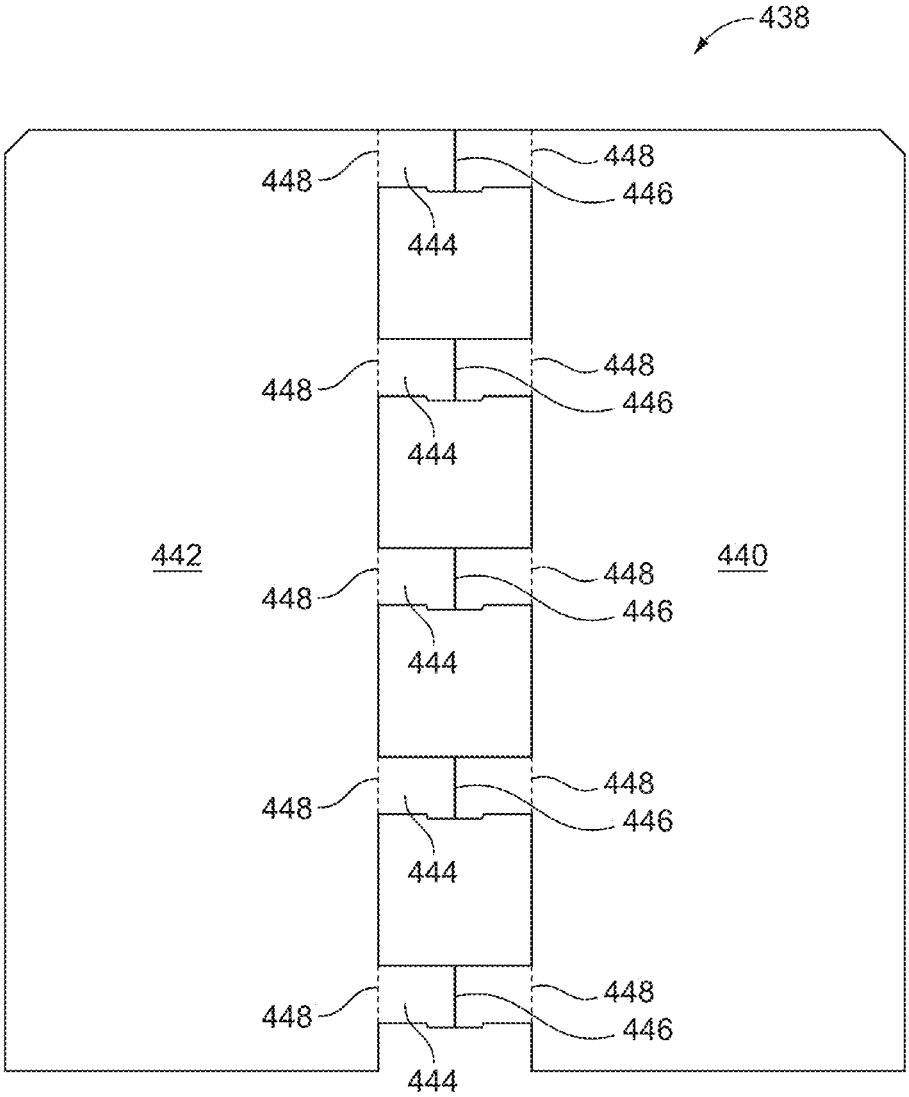
FIG. 18 is a plan view of a blank used to construct the inner supports of the display unit of an embodiment of the present invention.

FIG. 18 shows a blank 438 for constructing the inner supports 414 and 416. The blank 438 includes left inner support panel 440 and a right inner support panel 442. The left and right inner support panels 440 and 442 are connected by a plurality of shelf support panels 444. The left and right inner support panels 440 and 442 are separated along cut lines 446. The shelf support panels 444 are connected to the left and right inner support panels 440 and 442 along fold lines 448.

Figure 19:
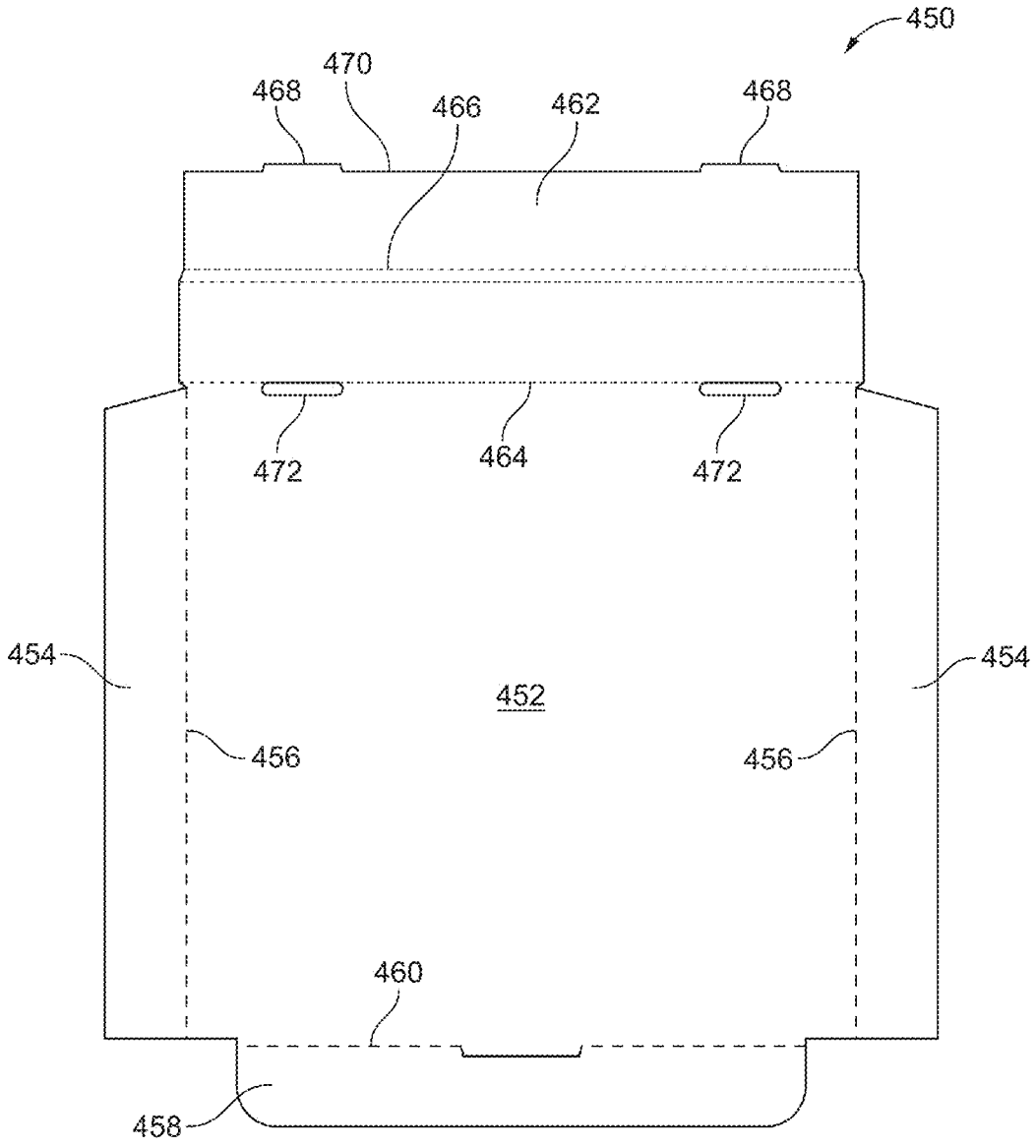
FIG. 19 is a plan view of a blank used to construct the shelf of the display unit of an embodiment of the present invention.

FIG. 19 shows a shelf blank 450 for constructing a shelf 408. The blank 450 includes a shelf panel 452 and side panels 454 attached to opposing ends of the shelf panel 452 along perforation lines 456. The blank 450 also includes a rear tab 458 attached to a first side of the shelf panel 452 along perforation line 460. The blank 450 includes a front panel 462 attached to a second side of the shelf panel 452 along fold line 464. The front panel 462 includes fold lines 466 and tabs 468 at its edge 470. The shelf panel 452 also includes slots 472 to accept tabs 468 when the blank 450 is folded to construct the shelf 408.

Figure 20:
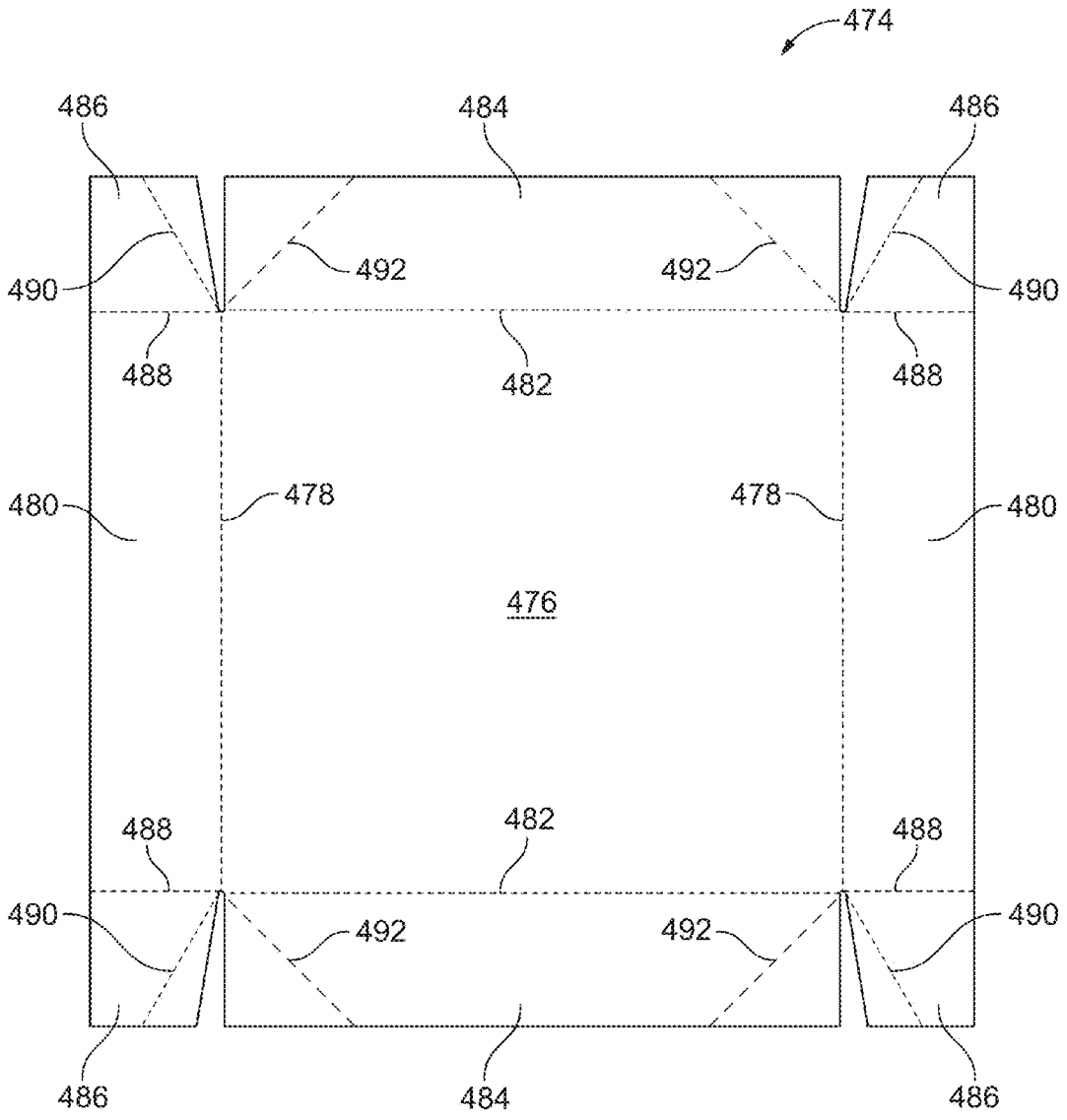
FIG. 20 is a plan view of a blank used to construct the bottom tray of the display unit of an embodiment of the present invention.
Figure 21:
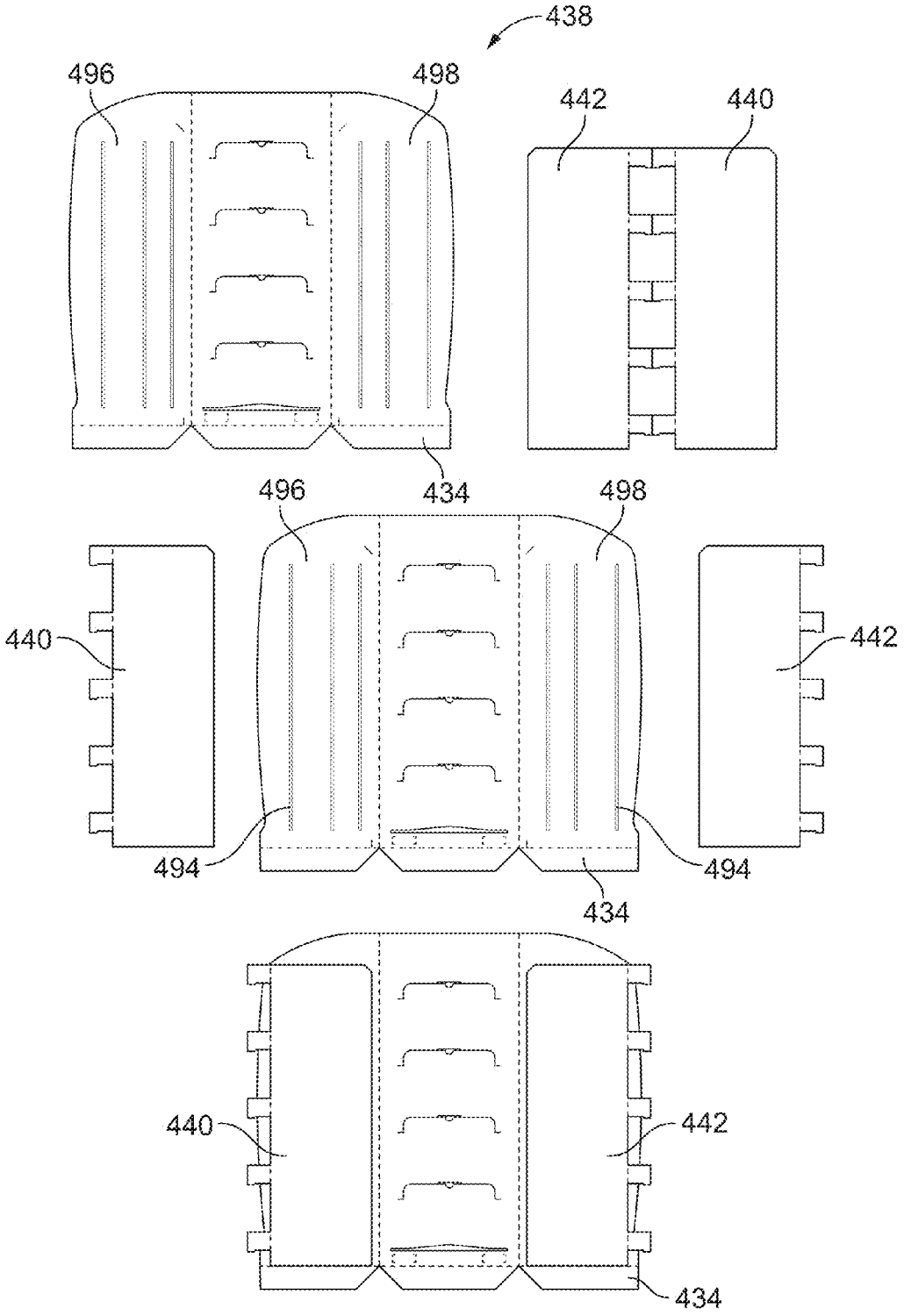
FIG. 21 is a schematic diagram showing construction of a portion of the display unit of an embodiment of the present invention.
Figure 22:
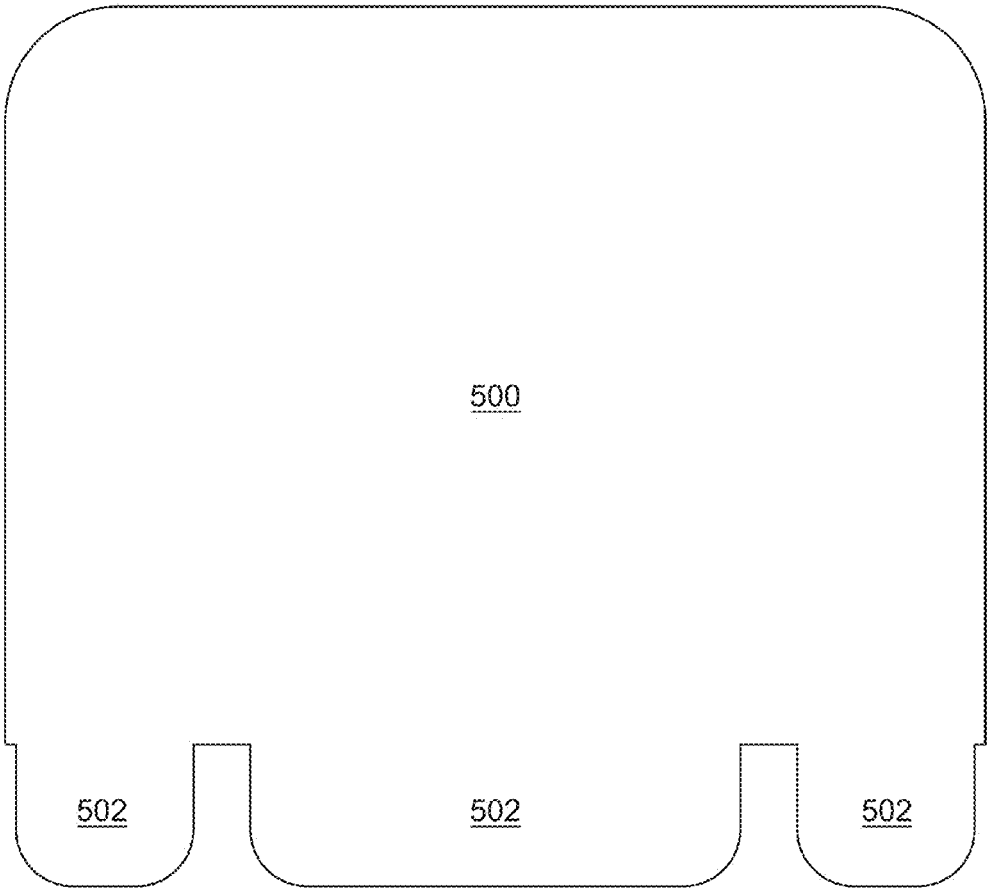
FIG. 22 is a plan view of a header of the display unit of an embodiment of the present invention.

FIG. 20 shows a bottom tray blank 474 for constructing the bottom tray 412. The bottom tray blank 474 includes a bottom panel 476. Attached along fold lines 478 at opposing edges of the bottom panel 476 are end panels 480. Attached along fold lines 482 at opposing sides of the bottom panel 476 are side panels 484. The end panels 480 include flaps 486 attached at fold lines 488. The flaps 486 have fold lines 490. The side panels 484 include perforation lines 492.

To construct the unit 400 (FIG. 21), the blank 438 is separated along cut lines 446 into the left and right inner support panels 440 and 442. The panels 440 and 442 are glued along glue lines 494 to inner surfaces 496 and 498 of the side wall panels 422 and 424 of blank 418, respectively, such that the shelf support panels 444 face away from the back wall panel 420. The left and right inner support panels 440 and 442 are located such that they are above the foot panels 434.

To construct the shelves 408 from shelf blank 450, the side panels 454 are folded downward along perforation lines 456. The front panel 462 is folded upward along fold lines 464 and 466 such that tables 468 engage slots 472. The front panel 462 forms a lip on the front of the shelf 408.

The left and right side wall panels 422 and 424 are folded in the same direction along fold lines 426 and 428 such that they are substantially parallel. The shelf support panels 444 are folded inward at fold lines 448 from the left and right side wall panels 422 and 424. The foot panels 434 are folded inward along fold lines 436. The shelves 408 are constructed as indicated above. The rear tab 458 of the shelf 408 is inserted into the opening create by manually pulling on slot 430 in the back wall panel 420. The shelf 408 is placed such that it rests on the shelf support panels 444. This is repeated for every shelf 408.

To construct the bottom tray 412, the side panels 484 and end panels 480 of the bottom tray blank 474 are folded upward along fold lines 478 and 482. The flaps 486 are folded along fold lines 488 and 490, and the side panels are folded along perforation lines 490 to create the tray 474. Glue may be used to securely construct the tray 474. The constructed blank 418 is inserted into the constructed bottom tray 412.

In this embodiment the header 410 (FIG. 22) may be attached to the back wall 402 for display or other purposes. The header 410 includes a planar surface area 500 and attachment tabs 502. The tabs 502 facilitate attachment to the back wall 402. All of the embodiments described herein may include a similar header to that shown in FIGS. 15 and 22.

While the specific embodiments have been illustrated and described, numerous modifications come to mind without significantly departing from the spirit of the invention, and the scope of protection is only limited by the scope of the accompanying Claims.

What is claimed is:

1. A display unit comprising:

a hutch formed from corrugated material, the hutch having a back wall, a first side wall extending from a first end of the back wall, and a second side wall extending from a second end of the back wall;

the back wall of the hutch including a plurality of spaced horizontal slots;

a separately formed first side wall support attached to an inner surface of the first side wall, and a separately formed second side wall support attached to an inner surface of the second side wall, the first side wall support including a plurality of spaced apart shelf support panels extending inward partway toward the second side wall and the second side wall support including a plurality of spaced apart shelf support panels extending inward partway toward the first side wall; and a plurality of shelves formed from a foldable blank of material, each shelf having a tab at a first end insertable into one of the plurality of spaced horizontal slots in the back wall, and a front panel at a second end folded over to form a front lip wherein the shelf is supported at the second end by one of the plurality of shelf support panels from the first side wall support and one of the plurality of shelf support panels from the second side wall support such that the shelf support panels are sandwiched within the folded front lip.

2. The display unit of claim 1 further comprising a shelf support pad.

3. The display unit of claim 1 further comprising a bottom tray.

4. The display unit of claim 1 further comprising a header.

5. The display unit of claim 1 further comprising a riser.

6. The display unit of claim 1 wherein the first side wall support and second side wall support are formed from a blank of material, the blank comprising a left inner support panel and a right inner support panel detachably connected by a plurality of shelf support panels.

7. The display unit of claim 1 wherein the back wall and first and second side walls are formed from a single blank of material, the blank comprising a back wall panel and a first side wall panel and a second side wall panel, the back wall panel including the plurality of spaced horizontal slots.

8. The display unit of claim 1 wherein the spaced horizontal slots are generally triangular shaped.

9. The display unit of claim 1 wherein the front panel forming the lip includes a tab positioned for insertion in a slot in the shelf.

10. A display unit comprising:

a hutch formed from corrugated material, the hutch having a back wall, a first side wall extending from a first end of the back wall, and a second side wall extending from a second end of the back wall;

a separately formed first side wall support glued to an inner surface of the first side wall, and a separately formed second side wall support glued to an inner surface of the second side wall, the first side wall support including a plurality of shelf support panels spaced from the back wall and extending inward partway toward the second side wall and the second side wall support including a plurality of shelf support panels spaced from the back wall and extending inward partway toward the first side wall; and a plurality of shelves formed from a foldable blank of material, each shelf having a front panel folded over to form a lip that is supported by the plurality of shelf support panels from the first side wall support and the plurality of shelf support panels from the second side wall support, wherein the support panels are sandwiched within the lip.

11. The display unit of claim 10 wherein the first side wall support is glued to the inner surface of the first side wall, and the second side wall support is glued to the inner surface of the second side wall.

12. The display unit of claim 10 further comprising a header.

13. The display unit of claim 10 further comprising a bottom tray.

* * * * *